US011087729B2

(12) United States Patent
Teng et al.

(10) Patent No.: US 11,087,729 B2
(45) Date of Patent: Aug. 10, 2021

(54) SYSTEM AND METHOD FOR RECORDING USER PERFORMANCE OF KEYBOARD INSTRUMENT

(71) Applicant: SUNLAND INFORMATION TECHNOLOGY CO., LTD., Shanghai (CN)

(72) Inventors: Yangyi Teng, Shanghai (CN); Xiaolu Liu, Shanghai (CN)

(73) Assignee: SUNLAND INFORMATION TECHNOLOGY CO., LTD., Shanghai (CN)

( * ) Notice: Subject to any disclaimer, the term of this patent is extended or adjusted under 35 U.S.C. 154(b) by 82 days.

(21) Appl. No.: 16/036,448

(22) Filed: Jul. 16, 2018

(65) Prior Publication Data

US 2018/0342230 A1 Nov. 29, 2018

Related U.S. Application Data

(63) Continuation of application No. PCT/CN2017/107660, filed on Oct. 25, 2017.

(30) Foreign Application Priority Data

Nov. 17, 2016 (CN) ..... 201611020079.X
Nov. 17, 2016 (CN) ..... 201621253640.4
Jan. 16, 2017 (WO) ..... PCT/CN2017/071222

(51) Int. Cl.
*G10H 1/00* (2006.01)
*G10H 1/055* (2006.01)
(Continued)

(52) U.S. Cl.
CPC ..... *G10H 1/0033* (2013.01); *G10C 3/16* (2013.01); *G10G 3/04* (2013.01); *G10H 1/0008* (2013.01);
(Continued)

(58) Field of Classification Search
CPC .. G10H 1/0033; G10H 1/0008; G10H 1/0553; G10H 1/0555; G10H 1/34;
(Continued)

(56) References Cited

U.S. PATENT DOCUMENTS 3,208,326 A * 9/1965 Bendall ..... G10C 3/18 84/255
3,927,594 A * 12/1975 Morita ..... G10H 1/344 84/237
(Continued)

FOREIGN PATENT DOCUMENTS

CN 101114445 A 1/2008
CN 201638541 U 11/2010
(Continued)

OTHER PUBLICATIONS

International Search Report in PCT/CN2017/107660 dated Feb. 1, 2018, 5 pages.
(Continued)

*Primary Examiner* — Christina M Schreiber
(74) *Attorney, Agent, or Firm* — Metis IP LLC

(57) ABSTRACT

A method for generating a music file for recording user performance may include: detecting, by a sensor, an event indicating a status change of an execution device of the keyboard instrument; generating, by the sensor, a signal corresponding to the detected event; receiving, by a processor, the signal; and generating, by the processor, a music file based on the signal. In some embodiments, the execution device may include a weight lever. The weight lever may a concrete structure in the keyboard instrument to simulate a rebound force generated by hammer striking on string, by striking on an elastic structure. In some embodiments, a rebound force for a first weight lever may be different from
(Continued)

a rebound force for a second weight lever by adjusting parameters of the elastic structure or the weight lever.

17 Claims, 15 Drawing Sheets

(51) Int. Cl.
*G10H 1/34* (2006.01)
*G10G 3/04* (2006.01)
*G10C 3/16* (2019.01)

(52) U.S. Cl.
CPC ..... *G10H 1/0553* (2013.01); *G10H 1/0555* (2013.01); *G10H 1/34* (2013.01); *G10H 1/346* (2013.01); *G10H 2220/221* (2013.01); *G10H 2220/305* (2013.01); *G10H 2220/521* (2013.01); *G10H 2230/011* (2013.01)

(58) Field of Classification Search
CPC ..... G10H 1/346; G10H 2220/221; G10H 2220/305; G10H 2220/521; G10H 2230/011; G10G 3/04; G10C 3/16
USPC ..... 84/609
See application file for complete search history.

(56) References Cited

U.S. PATENT DOCUMENTS 5,062,342 A * 11/1991 Nagatsuma ..... G10H 1/346 84/744
5,192,820 A * 3/1993 Kawamura ..... G10C 3/00 84/236
5,231,283 A 7/1993 Starkey et al.
5,237,123 A * 8/1993 Miller ..... G10G 3/04 84/21
5,524,521 A * 6/1996 Clift ..... G10G 3/04 84/462
5,583,310 A 12/1996 Sugiyama et al.
5,600,077 A 2/1997 Honda
5,610,356 A 3/1997 Koseki et al.
5,741,995 A 4/1998 Kawamura et al.
5,834,669 A * 11/1998 Clift ..... G10G 3/04 84/462
5,866,831 A * 2/1999 Kimble ..... G10H 1/346 84/433
5,945,617 A * 8/1999 Niitsuma ..... G10C 3/12 84/423 R
5,949,013 A 9/1999 Satoshi
6,194,649 B1 2/2001 Itou et al.
6,265,647 B1 7/2001 Tamaki et al.
6,362,412 B1 3/2002 Ura
6,423,889 B2 7/2002 Inoue
6,452,079 B2 9/2002 Sugiyama et al.
6,683,242 B2 1/2004 Inoue et al.
7,094,961 B2 8/2006 Ura et al.
7,825,312 B2 11/2010 Jones et al.
7,858,858 B2 12/2010 Eitaki et al.
7,960,629 B2 * 6/2011 Sasaki ..... G10F 1/02 84/21
7,973,233 B2 7/2011 Honda et al.
8,013,228 B2 * 9/2011 Shimizu ..... G10C 3/12 84/423 R
8,148,620 B2 4/2012 Jones et al.
8,288,640 B2 * 10/2012 Yaguchi ..... G10H 1/346 84/626
8,541,673 B2 9/2013 Jones et al.
8,933,316 B2 1/2015 Fujiwara et al.
9,336,765 B2 5/2016 Ishii
9,384,715 B2 7/2016 Taniguchi
9,502,014 B1 11/2016 Fujiwara et al.
9,899,014 B2 2/2018 Nishimura
10,553,190 B2 * 2/2020 Ogawa ..... G10H 1/34
2001/0007220 A1 * 7/2001 Koseki ..... G10H 1/344 84/615
2001/0035086 A1 * 11/2001 Sugiyama ..... G10C 5/10 84/423 R
2002/0046640 A1 * 4/2002 Kondo ..... G10H 1/053 84/615
2002/0121183 A1 9/2002 Inoue et al.
2003/0110897 A1 * 6/2003 Itou ..... G10C 5/10 81/2
2003/0131711 A1 7/2003 Wenjun
2005/0092164 A1 5/2005 Fujiwara et al.
2005/0145104 A1 * 7/2005 Sasaki ..... G10H 1/344 84/746
2005/0211048 A1 9/2005 Fujiwara
2005/0211079 A1 9/2005 Sasaki et al.
2005/0235801 A1 10/2005 Muramatsu et al.
2005/0246459 A1 * 11/2005 Philipp ..... G10H 1/34 710/67
2006/0027069 A1 * 2/2006 Ura ..... G10H 1/0008 84/13
2006/0162534 A1 * 7/2006 Muramatsu ..... G01D 18/008 84/724
2006/0185497 A1 8/2006 Hirota et al.
2007/0169608 A1 * 7/2007 Fujiwara ..... G10F 1/02 84/13
2007/0214944 A1 9/2007 Sasaki et al.
2007/0221036 A1 * 9/2007 Fujiwara ..... G10F 1/02 84/21
2008/0163741 A1 * 7/2008 Ishihara ..... G10C 3/12 84/435
2008/0276789 A1 * 11/2008 Shimizu ..... G10C 3/12 84/433
2010/0229707 A1 * 9/2010 Sasaki ..... G10F 1/02 84/20
2011/0067557 A1 * 3/2011 Komatsu ..... G10C 3/12 84/744
2013/0125727 A1 * 5/2013 Taylor ..... G10F 1/02 84/21
2013/0125735 A1 * 5/2013 Mori ..... G10H 1/32 84/723
2013/0233150 A1 * 9/2013 Komatsu ..... G10H 1/346 84/439
2014/0020543 A1 1/2014 Oba et al.
2014/0305277 A1 * 10/2014 Fujiwara ..... G10C 3/20 84/225
2015/0145104 A1 5/2015 Bauer et al.
2017/0206869 A1 * 7/2017 Okuyama ..... G10G 3/04
2018/0012574 A1 * 1/2018 Yaguchi ..... G10C 3/16
2018/0033407 A1 * 2/2018 Ohnishi ..... G10H 1/045
2018/0322853 A1 * 11/2018 Shepherd ..... G10H 1/34
2018/0342230 A1 * 11/2018 Teng ..... G10H 1/0008
2019/0027121 A1 * 1/2019 Ichiki ..... G10H 1/34
2019/0051277 A1 * 2/2019 Yan ..... G10H 1/344
2019/0251939 A1 * 8/2019 Ichiki ..... G10C 3/12
2019/0304413 A1 * 10/2019 Liu ..... G10C 3/07
2019/0340950 A1 * 11/2019 Yan ..... G09B 15/023

FOREIGN PATENT DOCUMENTS

CN 102165122 A 8/2012
CN 102693715 A 9/2012
CN 102737624 A 10/2012
CN 102760051 A 10/2012
CN 202796012 U 3/2013
CN 205862777 U 1/2017
CN 20674473 U 10/2017
EP 1881479 A2 1/2008
JP H0916177 A 1/1997
JP H0997074 A 4/1997
JP 2917609 B2 7/1999
WO 2013080370 A1 6/2013

OTHER PUBLICATIONS

Written Opinion in PCT/CN2017/107660 dated Feb. 1, 2018, 5 pages.

(56) References Cited

OTHER PUBLICATIONS

First Office Action in Chinese Application No. 201711011227.6 dated Aug. 4, 2020, 25 pages.
International Search Report in PCT/CN2017/071222 dated Oct. 25, 2017, 5 Pages.
Written Opinion in PCT/CN2017/071222 dated Oct. 25, 2017, 4 Pages.
Qin, Xiaocheng et al., LED Touch Keyboard, Internet of Things Technologies, 2013, 3 pages.
Loewe Wong., An Analysis on the Current Situation of the Digital Piano Market, Musical Instruction, 2013, 4 pages.
Cheng, Tian et al., Improving Piano Note Tracking by HMM Smoothing, 2015 23rd European Signal Processing Conference (EUSIPCO), 2015, 5 pages.

* cited by examiner

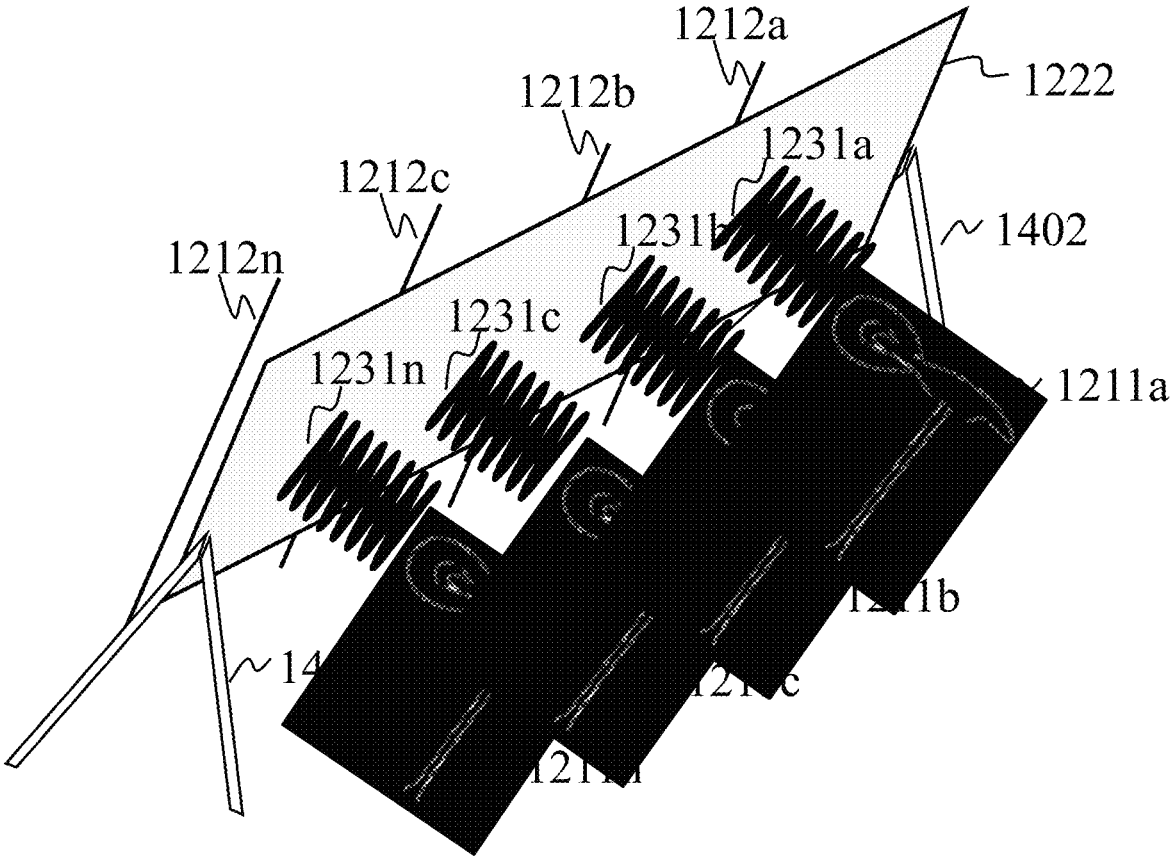
FIG. 14-A

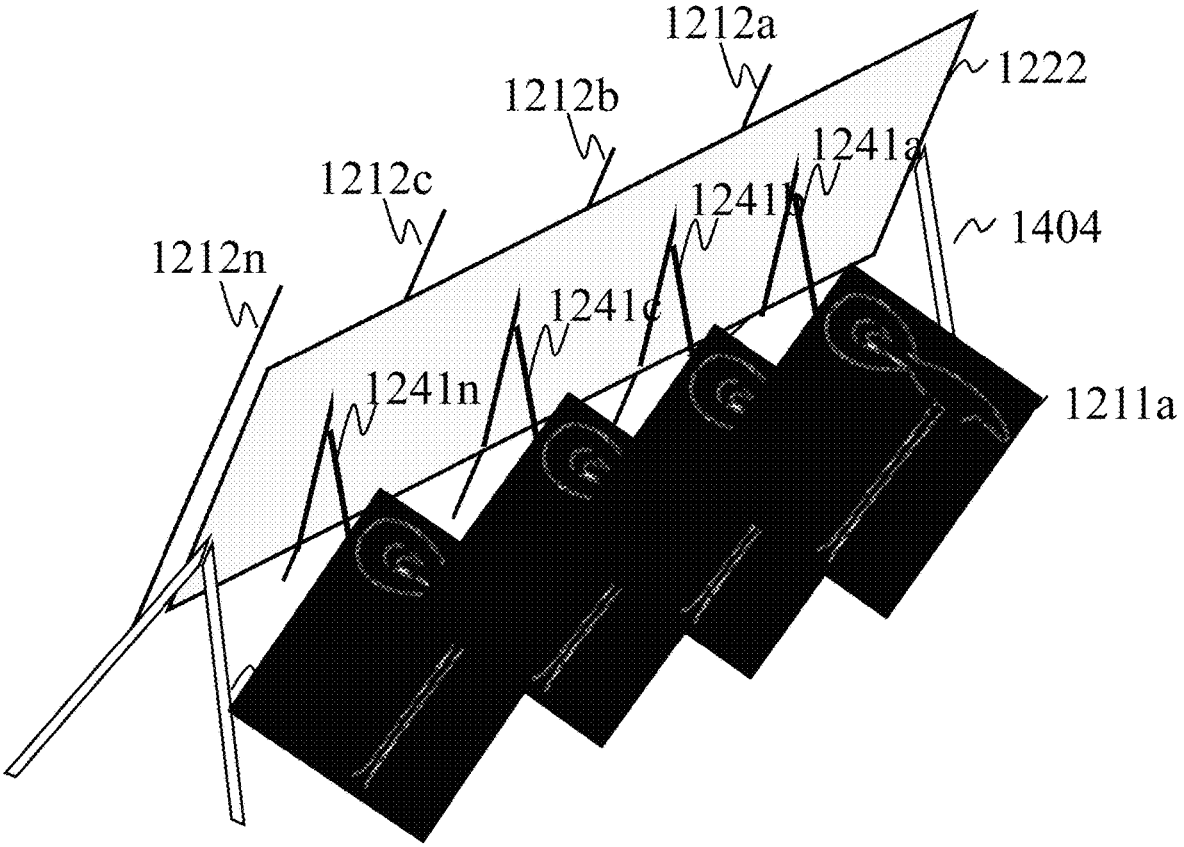
FIG. 14-B

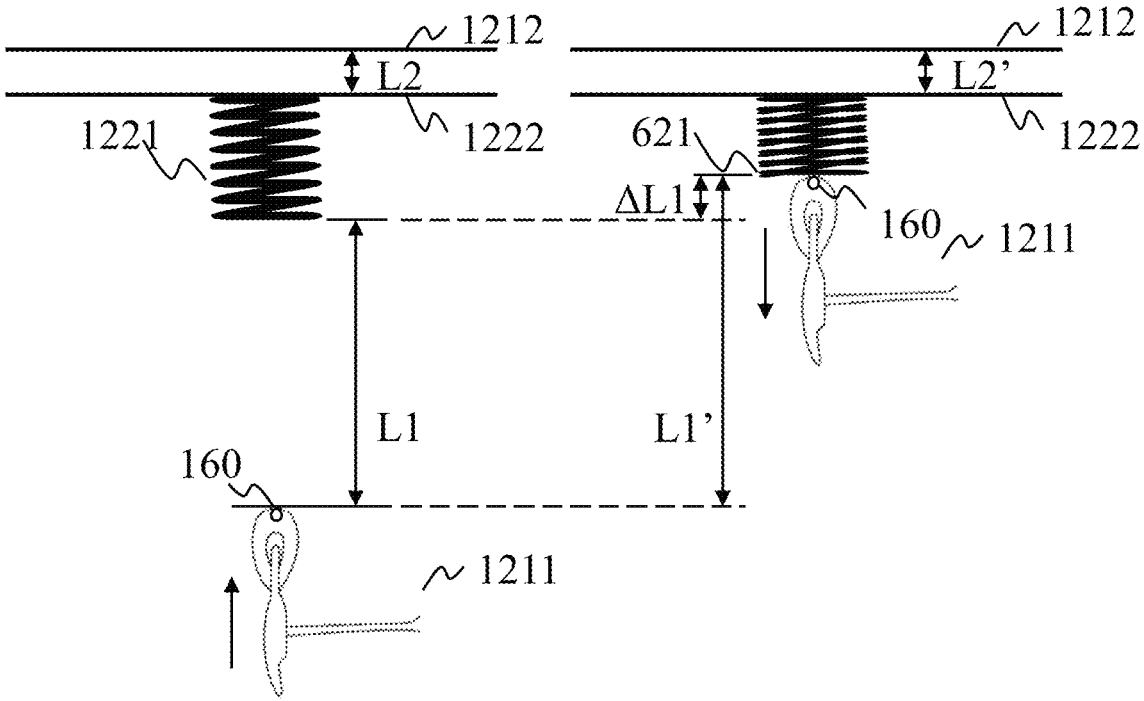
FIG. 15-A FIG. 15-B

SYSTEM AND METHOD FOR RECORDING USER PERFORMANCE OF KEYBOARD INSTRUMENT

CROSS-REFERENCE TO RELATED APPLICATIONS

This application is a Continuation of International Application No. PCT/CN2017/107660, filed on Oct. 25, 2017, which claims priority of PCT Application No. PCT/CN2017/071222 filed on Jan. 16, 2017, Chinese Application No. 201621253640.4 filed on Nov. 17, 2016, and Chinese Application No. 201611020079. X filed on Nov. 17, 2016. Each of the above-referenced applications are incorporated by reference in their entirety.

TECHNICAL FIELD

This application relates to the field of performance detection and, more particularly, the detection of user performance of a keyboard instrument.

BACKGROUND

A keyboard instrument is a musical instrument with a keyboard. Exemplary keyboard instruments may include pianos, organs, accordions, or the like. The keyboard instrument has been widely used for entertainment, learning, and other purposes. While playing a keyboard instrument, a player does not strike the strings directly, but presses the keys instead. Mechanical motions generated by pressing keys may be conducted by mechanical structures included in the keyboard instrument and may further activate some components of the keyboard instrument to generate sound. With rapid development of electronic process of the keyboard instrument, the demand for recording player's performance information is increasing. Conventional keyboard detection method may include electromagnetic induction type and reed type. The electromagnetic induction method may convert the motion of the keys into electrical signals. The reed method may execute an on-off control corresponding to the motion of the keyboard and generate a related electrical signal during operation. However, these keyboard detection methods do not detect the sound generating components of the keyboard instrument directly. In other words, these methods are secondary detection methods and may not exactly reflect the player's actual performance. Therefore, it is desirable to provide a method and system to improve the detection accuracy of the user performance.

SUMMARY

According to an aspect of the present disclosure, a method may include: detecting, by a sensor, an event indicating a status change of an execution device of the keyboard instrument; generating, by the sensor, a signal corresponding to the detected event; receiving, by a processor, the signal; and generating, by the processor, a music file based on the signal.

In some embodiments, the method may further include transmitting, by the processor, the music file to a media player.

In some embodiments, the method may further include controlling, by the processor, an auto-play actuator based on the music file.

In some embodiments, the execution device may include at least one of a key, a pedal, a hammer, or a weight lever.

In some embodiments, the signal may be preprocessed by a signal processing circuit before it is received by the processor, the preprocessing including at least one of amplifying, frequency-selecting, smoothing, peak holding, channel selecting, or analog-to-digital converting.

In some embodiments, the generating, by the processor, the music file based on the signal may include: obtaining timing information related to the user performance, the timing information including at least one of timing information related to pressing a key or using a pedal; processing the signal according to the obtained timing information; and generating the music file based on the processed signal.

In some embodiments, the execution device may include a weight lever, the weight lever being a concrete structure in the keyboard instrument to simulate a rebound force generated by hammer striking on string, by striking on an elastic structure.

In some embodiments, a rebound force for a first weight lever may be different from a rebound force for a second weight lever by adjusting parameters of the elastic structure or the weight lever.

In some embodiments, the sensor may be configured to detect a strike by the weight lever to the elastic structure.

In some embodiments, the sensor may be connected to the weight lever.

In some embodiments, the sensor may be connected to the elastic structure.

In some embodiments, a buffer layer may reside between the sensor and the elastic structure, and a vibration conduction layer may reside between the sensor and the weight lever.

In some embodiments, the generated signal may include a first signal and a second signal, the first signal being generated in response to a first event indicating a movement of a key, the second signal being generated in response to a second event indicating a movement of a linkage structure, and the music file is generated based on the first and second signals.

In some embodiments, the execution device of the keyboard instrument may include a linkage structure, the sensor may include a first sensor and a second sensor, and the detecting, by the sensor, the event indicating the status change of the execution device of the keyboard instrument may include: detecting, by the first sensor, a key motion of the keyboard instrument; generating, by the first sensor, a first signal; receiving, by the processor, the first signal to generate a control signal for controlling the second sensor for detecting a motion of the linkage structure; and receiving, by the second sensor, the control signal to detect the motion of linkage structure.

In some embodiments, the method may further include: determining a parameter value of the signal indicating a status change of the execution device of the keyboard instrument; determining whether the parameter value is less than a threshold; and determining, if the parameter value is less than a threshold, the signal is generated in response to an interference event.

According to another aspect of the present disclosure, a system for generating a music file for recording user performance may include: at least one processor; and storage for storing instructions, the instructions, when executed by the at least one processor, causing the system to perform a method including: detecting, by a sensor, an event indicating a status change of an execution device of the keyboard instrument; generating, by the sensor, a signal corresponding to the detected event; receiving, by the at least one processor, the signal; and generating, by the at least one processor, a music file based on the signal.

In some embodiments, the execution device may include a weight lever, the weight lever being a concrete structure in the keyboard instrument to simulate a rebound force generated by hammer striking on string, by striking on an elastic structure.

In some embodiments, the generated signal may include a first signal and a second signal, the first signal being generated in response to a first event indicating a movement of a key, the second signal being generated in response to a second event indicating a movement of a linkage structure, and the music file is generated based on the first and second signals.

In some embodiments, the execution device of the keyboard instrument may include a linkage structure, the sensor includes a first sensor and a second sensor, and the detecting, by the sensor, the event indicating the status change of the execution device of the keyboard instrument may include: detecting, by the first sensor, a key motion of the keyboard instrument; generating, by the first sensor, a first signal; receiving, by the processor, the first signal to generate a control signal for controlling the second sensor for detecting a motion of the linkage structure; and receiving, by the second sensor, the control signal to detect the motion of linkage structure.

In some embodiments, the method may further include: determining a parameter value of the signal indicating a status change of the execution device of the keyboard instrument; determining whether the parameter value is less than a threshold; and determining, if the parameter value is less than a threshold, the signal is generated in response to an interference event.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein:

FIGS. 14-A and 14-B are diagrams illustrating exemplary execution module and muting unit according to some embodiments of the present disclosure.

FIGS. 15-A and 15-B are diagrams illustrating exemplary mechanisms for implementing execution module according to some embodiments of the present disclosure.

DETAILED DESCRIPTION

In the following detailed description, numerous specific details are set forth by way of examples in order to provide a thorough understanding of the relevant disclosure. However, it should be apparent to those skilled in the art that the present disclosure may be practiced without such details. In other instances, well-known methods, procedures, systems, components, and/or circuitry have been described at a relatively high-level, without detail, in order to avoid unnecessarily obscuring aspects of the present disclosure. Various modifications to the disclosed embodiments will be readily apparent to those skilled in the art, and the general principles defined herein may be applied to other embodiments and applications without departing from the spirit and scope of the present disclosure. Thus, the present disclosure is not limited to the embodiments shown, but to be accorded the widest scope consistent with the claims.

It will be understood that the term "system," "unit," "module," and/or "engine" used herein are one method to distinguish different components, elements, parts, section or assembly of different level in ascending order. However, the terms may be displaced by other expression if they may achieve the same purpose.

It will be understood that when a unit, module or engine is referred to as being "on," "connected to," or "coupled to" another unit, module, or engine, it may be directly on, connected or coupled to, or communicate with the other unit, module, or engine, or an intervening unit, module, or engine may be present, unless the context clearly indicates otherwise. As used herein, the term "and/or" includes any and all combinations of one or more of the associated listed items.

The terminology used herein is for the purposes of describing particular examples and embodiments only, and is not intended to be limiting. As used herein, the singular forms "a," "an," and "the" may be intended to include the plural forms as well, unless the context clearly indicates otherwise. It will be further understood that the terms "include," and/or "comprise," when used in this disclosure, specify the presence of integers, devices, behaviors, stated features, steps, elements, operations, and/or components, but do not exclude the presence or addition of one or more other integers, devices, behaviors, features, steps, elements, operations, components, and/or groups thereof.

Figure 1:
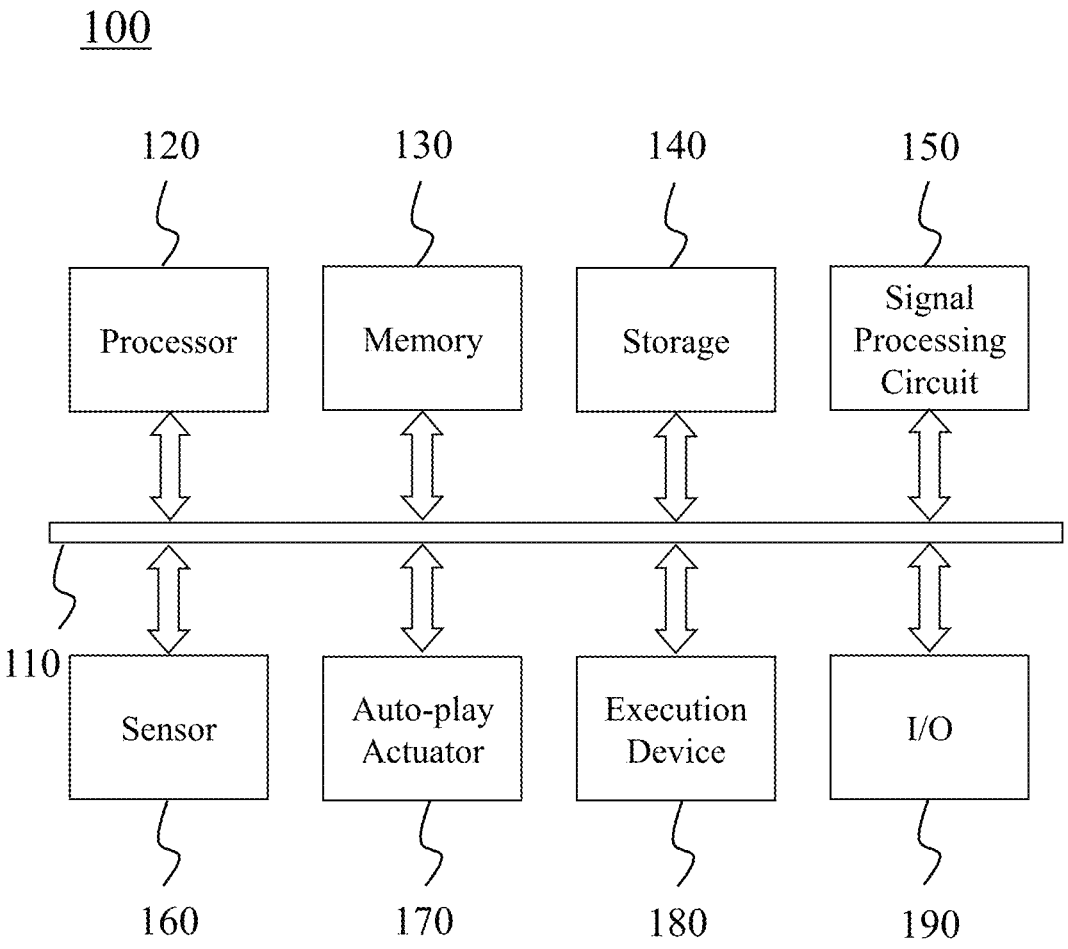
FIG. 1 is a block diagram illustrating an exemplary keyboard instrument system according to some embodiments of the present disclosure.

The disclosure is directed to systems and methods for recording user performance of a keyboard instrument. Various types of sensor may be placed within or outside of the keyboard instrument to detect the user performance. FIG. 1 is a block diagram illustrating an exemplary keyboard instrument system according to some embodiments of the present disclosure. As shown in FIG. 1, the keyboard instrument system 100 may include, among others, a data bus 110, a processor 120, a memory 130, a storage 140, a signal processing circuit 150, one or more sensors 160, an auto-play actuator 170, an execution device 180, and I/O 190. More or less components may be included in the keyboard instrument system 100. For example, two of the above-mentioned components may be combined into a single device, or one of the components may be divided into two or more devices. The components may be in communication with each other via the data bus 110. The data bus 110 may be used to facilitate data communications between the components of the keyboard instrument system 100.

In some embodiments, the processor 120 may be configured to process data and signals. The processor may be configured to execute instructions stored in Memory 130 and/or Storage 140. When executing the instructions, the processor 120 may cause the keyboard instrument system 100 to perform one or more functions disclosed in this application. Exemplary processor 120 may include a microcontroller, a reduced instruction set computer (RISC), an application specific integrated circuits (ASICs), an application-specific instruction-set processor (ASIP), a central processing unit (CPU), a graphics processing unit (GPU), a physics processing unit (PPU), a microcontroller unit, a digital signal processor (DSP), a field programmable gate array (FPGA), an acorn reduced instruction set computing (RISC) machine (ARM), and any other circuit and/or processor capable of executing the functions described herein, or the like, or any combination thereof.

The memory 130 may be configured to store data. Exemplary types of data may include MIDI files, user information, user performance recordings, or the like, or a combination thereof. The memory 130 may also be configured to store the instructions executed by the processor 120. The memory 130 may include a random-access memory (RAM), a dynamic random-access memory (DRAM), a static random-access memory (SRAM), a thyristor random-access memory (T-RAM), a zero-capacitor random-access memory (Z-RAM), a read-only memory (ROM), a mask read-only memory (MROM), a programmable read-only memory (PROM), a field programmable read-only memory (FPROM), one-time programmable non-volatile memory (OTP NVM), and any other circuit and/or memory capable of executing the functions described herein, or the like, or any combination thereof.

The storage 140 may be configured to store data. Exemplary types of data may include MIDI files, user information, user performance recordings, or the like, or a combination thereof. The storage 140 may also be configured to store the instructions executed by the processor 120. The storage 140 may include a direct attach storage (DAS), a fabric-attached storage (FAS), a storage area network (SAN), a network attached storage (NAS), any other circuit and/or storage capable of executing the functions described herein, or the like, or any combination thereof. Generally, the processor 120, the memory 130, the storage 140, and some other components may be integrated in one device, e.g., desktops, laptops, mobile phones, tablet computers, wearable computing devices, or the like, or a combination thereof.

The signal processing circuit 150 may be configured to process signals provided by the sensor(s) 160 and/or any other components of the keyboard instrument system 100. Exemplary signal processing circuit 150 may include a signal amplification circuit, a signal conversion circuit, a signal filtering circuit, a channel selecting circuit, an analog-to-digital converter, or any other circuit capable of executing the functions described herein, or the like, or any combination thereof.

The sensor(s) 160 may be configured to monitor the keyboard instrument system 100 in response to operations by a user when the user plays the keyboard instrument system 100. The monitoring may be depend on the types of the sensor(s) 160. For example, a camera (i.e., a type of sensor 160) may be used to record user performance. A microphone (i.e., another type of sensor 160) may be used to detect sound generated by the keyboard instrument system 100. A motion detection sensor may be used to detect motions of the components of the keyboard instrument system 100. The sensor(s) 160 may include, for example, one or more electro-optical sensors, electromagnetic sensors, Hall sensors, vibration sensors, ultrasonic sensors, laser sensors, motion sensors, piezoelectricity sensors, pressure sensors, torque sensors, differential pressure sensors, resistance sensors, conductivity sensors, tilt sensors or any other circuit and/or sensor capable of executing the functions described herein, or the like, or any combination thereof.

The auto-play actuator 170 may be configured to automatically execute auto-play functions of the keyboard instrument system 100 based on musical data received. Exemplary musical data may include the data about the keys that are depressed or released, timing information related to operations of one or more pedals, pressure on the pedals, one or more musical notes to be produced, etc. The auto-play actuator 170 may drive keys of the keyboard instrument system 100 to be pressed to generated sound based on the musical data. The auto-play actuator ζmay include any circuit and/or device capable of executing the functions described herein.

The execution device 180 may include one or more components of the keyboard instrument system 100 that may be activated during operation. Exemplary execution device 180 may include one or more keys, pedals, linkage structures, string, motion conduction components, or the like, or a combination thereof. In some embodiments, the linkage structure may include a hammer, weight lever, or the like, or a combination thereof. The weight lever may include a concrete structure configured in an electronic keyboard instrument to simulate real rebound feeling generated by striking a piece of string by a hammer. For example, the weight lever may be made of elastic material and with a density similar to the density of hammer used in a piano. The rebound force of the weight lever may be similar to the rebound force of the hammer. The motion conduction components may refer to components that may be activated during an operation of the keyboard instrument system 100.

The I/O 190 may be configured to allow a user to interact with the keyboard instrument system 100. The I/O 190 may include one or more common input and output devices, e.g., a keyboard, a mouse, an audio output device (e.g., a microphone), a printer, a display, etc.

Figure 2:
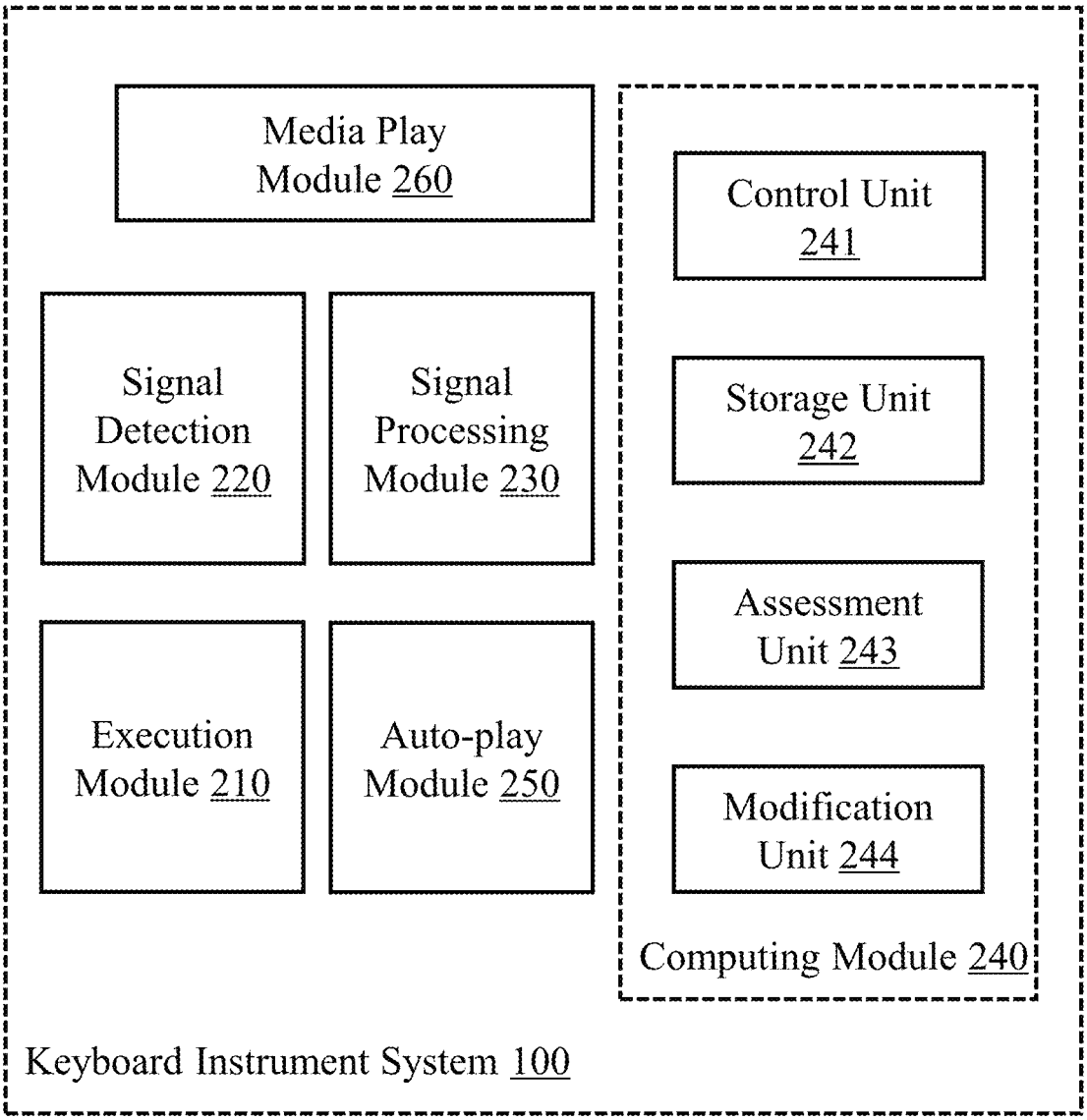
FIG. 2 is a block diagram illustrating an exemplary keyboard instrument system according to some embodiments of the present disclosure.

FIG. 2 is a block diagram illustrating an exemplary keyboard instrument system according to some embodiments of the present disclosure. As shown, the keyboard instrument system 100 may include an execution module 210, a signal detection module 220, a signal processing module 230, a computing module 240, an auto-play module 250, and a media play module 260. Generally, the terms "module," "unit," and/or "engine" used herein, refers to logic embodied in hardware or firmware, or to a collection of software instructions. The modules, units, and engines described herein may be implemented as software and/or hardware modules and may be stored in any type of non-transitory computer-readable medium or other storage device. In some embodiments, a software module may be compiled and linked into an executable program. It will be appreciated that software modules can be callable from other modules or from themselves, and/or can be invoked in response to detected events or interrupts. Software modules configured for execution on computing devices (e.g., processor 120) can be provided on a computer readable medium, such as a compact disc, a digital video disc, a flash drive, a magnetic disc, or any other tangible medium, or as a digital download (and can be originally stored in a compressed or installable format that requires installation, decompression, or decryption prior to execution). Such software code can be stored, partially or fully, on a memory device of the executing computing device, for execution by the computing device. Software instructions can be embedded in a firmware, such as an EPROM. It will be further appreciated that hardware modules can be included of connected logic units, such as gates and flip-flops, and/or can be included of programmable units, such as programmable gate arrays or processors. The modules or computing device functionality described herein are preferably implemented as software modules, but can be represented in hardware or firmware. In general, the modules described herein refer to logical modules that can be combined with other modules or divided into sub-modules despite their physical organization or storage.

The computing module 240 may further include a control unit 241, a storage unit 242, an assessment unit 243, and a modification unit 244. The connection method between the modules may be wired or wireless. Data and/or signals may be transmitted between the modules.

The execution module 210 may include the execution device 180 as described in connection with FIG. 1. The execution module 210 may include one or more keys, pedals, linkcage structure, motion conduction components, strings, and/or any other component of the keyboard instrument. The motion conduction components may be activated during an operation by a user. In some embodiments, the execution module 210 may cause an event in response to a user performance. The type of the event may include but is not limited to, motion, sound, vibration, or the like, or a combination thereof. The type of the event caused by the execution module 210 may depend on the execution devices 180 included therein. For example, if a user presses a key, a key motion may be defined as an event. Likewise, the pedal motion trod by the user may be defined as an event. Accordingly, some motion of some components of the keyboard instrument system 100 in response to the motion of the key and/or the pedal may be defined as an event. Merely by way of example, a hammer may strike a string of the keyboard instrument system 100 in response to a key pressing by the user. The motion of the hammer and/or the vibration of the string may be defined as an event. As a result, the vibration of the string, a sound may be generated. The generated sound may also be an event. Likewise, any status change of the execution devices may be defined as an event. An event may contain performance information of the user. For example, a well-trained user may know when to press a key, which key is to be pressed, how strongly to press a key, how to control a pedal, or the like, or a combination thereof, which may be characterized by the keyboard instrument system 100 as some performing characteristics relating to the events caused by the execution devices of the keyboard instrument system 100. The performing characteristics may include timing, serial number, strength, duration, or the like, or a combination thereof. The performing characteristics may be recorded by analyzing the events by the keyboard instrument system 100 (e.g., the signal detection module 220 and/or the computing module 240).

The signal detection module 220 may be configured to detect the events caused by the execution module 210. The signal detection module 220 may include one or more sensors 160. The signal detection module 220 may analyze the events detected and determine the performing characteristics of the events based on the analysis. The configuration of the sensors 160 (e.g., the numbers and/or positions of the sensors 160) may depend on the type of the event to be detected. For example, a plurality of electro-optical sensors may be positioned under the plurality of keys of the keyboard instrument system 100 to detect the motion of individual keys. In some embodiments, the event to be detected may be a mechanical motion of a component of the keyboard instrument system 100. The position of a sensor 160 may depend on where the event to be detected occurs. For example, the sensor(s) 160 may be positioned on or near a string to detect a vibration of the string. The sensor(s) 160 may be positioned on or near the plurality of keys to detect the key motion. The sensor(s) 160 may be positioned on or near the linkage structure of the keyboard instrument system 100 to detect the strike by the linkage structure. In some embodiments, the numbers of the sensor(s) 160 may depend on the numbers of the keys of the keyboard instrument system 100. For example, a sensor 160 may correspond to every a certain number of keys (e.g., two or four keys) of the keyboard instrument system 100, and the keyboard instrument system 100 may include 21 sensors 160 for detecting the motion of the keys. In some embodiments, the keyboard instrument system 100 may include one or more additional sensors 160 to filter some interference caused by various events. The sensors 160 included in the signal detection module 220 may be positioned inside or external to the keyboard instrument system 100, and the position of the sensors 160 may depend on the event to be detected or the method to detect a certain event. For example, if the key pressing event is to be detected by a camera (i.e., a sensor 160), the camera may be external to the keyboard instrument system 100. The signal detection module 220 may generate a signal in response to a detected event. The original signal may be a voltage signal, a current signal, or the like, or a combination thereof.

The signal processing module 230 may be configured to process the signal and further transmit the processed signal to the computing module 240. The signal processing module 230 may include the signal processing circuit 150 as described in connection with FIG. 3 elsewhere in this disclosure. The computing module 240 can determine performance information contained in the signal. In some embodiments, the signal may be preprocessed by the signal processing module 230. Exemplary preprocessing may include amplifying, frequency-selecting, smoothing, peak holding, channel selecting, analog-to-digital converting, or the like, or a combination thereof. In some embodiments, the processing may further include converting the signal into a wireless signal. For example, if the computing module 240 is a mobile phone, the signal may need to be processed and sent to the mobile phone wirelessly. After the processing, the signal processing module 230 may transmit the processed signal to the computing module 240.

The computing module 240 may be configured to receive and process the processed signal received from the signal processing module 230. The computing module 240 may include a control unit 241, a storage unit 242, an assessment unit 243, and a modification unit 244. The computing module 240 may include processor 120 as described in connection with in FIG. 1. The computing module 240 may be integrated in or external to the keyboard instrument system 100. In some embodiments, the units in the computing module 240 may be set inside the keyboard instrument system 100. For example, in a smart piano, a computer may be configured inside. In some embodiments, a traditional keyboard instrument may be reconstructed to be the kind of keyboard instrument disclosed in the present disclosure. Under this circumstance, the computing module 240 may be difficult to be integrated into the traditional keyboard instrument. A removable computing module 240 may be available for the reconstructed traditional keyboard instrument. The connection between the reconstructed traditional keyboard instrument and the removable computing module 240 may through wired connection or wireless connection. The computing module 240 may be a computing device capable to perform the functions thereof disclosed in this application. Exemplary computing device may include PC (personal computer), mobile phone, tablet PC, laptop, or the like, or a combination thereof.

The control unit 241 may be configured to control operations one or more components of the keyboard instrument system 100. For example, the control unit 241 can control a sound box of the keyboard instrument to generate sounds. As another example, control an auto-play actuator 170 to perform one or more auto-play operations. A control signal may be generated based on the processed signals transmitted from the signal processing module 230.

The storage unit 242 may include the memory 130 and the storage 140 as described in connection with in FIG. 1. The storage unit 142 may store some user information, or some MIDI files, or some videos can be played on a display, or the like, or a combination thereof.

The assessment unit 243 may be configured to perform some assessment operations. For example, an event detected by the signal detection module 220 may be an interference event, which may be an event that is not intended to be detected during operation. In some embodiments, the assessment unit 243 may determine one or more parameters related to the event. The assessment unit 243 may also determine whether the value(s) of the one or more parameter satisfies a predetermined criteria to determine whether the event is an interference event. For example, when vibrations of a linkage structure are detected, vibrations caused by a component rather than the linkage structure of the keyboard instrument system 100 and detected by the sensor 160 may be considered as interference events. The assessment unit 243 may determine the intensity of the vibration and determine whether the intensity is less than a threshold. When determining that the intensity of the vibration is less than a threshold, the assessment unit 243 may determine that the vibration is an interference event. In some embodiments, the signal that is determined to be caused by an interference event may be filtered and not included in further processing or recording.

The modification unit 244 may be configured to perform some modification operations to the received signal. For example, the processed signal received from the signal processing module 230 may be used to generate a music file for tracking (or recording) the performance by the user. The received signal may be modified to adjust some timing error included therein. For example, the recording of the user performance may have a time delay between the user's pressing keys and the sound generated. Merely by way of example, because of some mechanical errors of the components of the keyboard instrument system 100, generating the sound may be later than pressing the corresponding key and/or pedal. And for different keys and/or pedals, the corresponding mechanical errors may be different. Therefore, the mechanical errors may need to be compensated by processing the received signals. The modification module 244 may process the received signals to compensate the time delay caused by the mechanical errors. The processing may include adjusting the timing information included in the received signal. Some other operations to the received may also be performed by the modification unit 244.

The auto-play module 250 may be configured to execute auto-play functions of the keyboard instrument system 100. In some embodiments, the auto-play functions may be executed based on one or more control signals generated by the computing module 240. The auto-play module 250 may include the auto-play actuators described in connection with FIG. 1. In some embodiments, the auto-play module 250 may include one or more key actuators, one or more pedal actuators, and/or any other component for performing one or more functions of the auto-play module 250. The key actuator(s) may drive one or more keys of the keyboard instrument system 100. The one or more pedal actuators may drive one or more pedals of the keyboard instrument system 100. The key actuators and/or the pedal actuators may be driven by one or more motors (not shown). For example, the key actuators and/or the pedal actuators may include one or more solenoids to provide energy for driving the one or more keys and/or pedals.

The media play module 260 may be configured to play one or more music files generated by the keyboard instrument system 100. The media play module 260 may include a music player that may be connected with the keyboard instrument system 100 with a wired or wireless method. Upon receiving a music file, the media play module 260 may execute music play programs installed therein to play the music file. Exemplary music player may include a speaker, a mobile terminal, a personal computer, a smartphone, a personal digital assistant, a tablet, a laptop, a car computer, a hand-held gaming device, smart glasses, a smart watch, a wearable device, a virtual display device, a smart television, or the like, or any combination thereof.

It should be noted that the keyboard instrument system 100 described above is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure. Some modules may be removed from the keyboard instrument system 100. For example, the auto-play module 250 may not be essential in the keyboard instrument system 100. Some modules may be integrated. For example, the media play module 260 may be integrated into the computing module 240. The signal processing module 230 may be integrated into the computing module 240.

Figure 3:
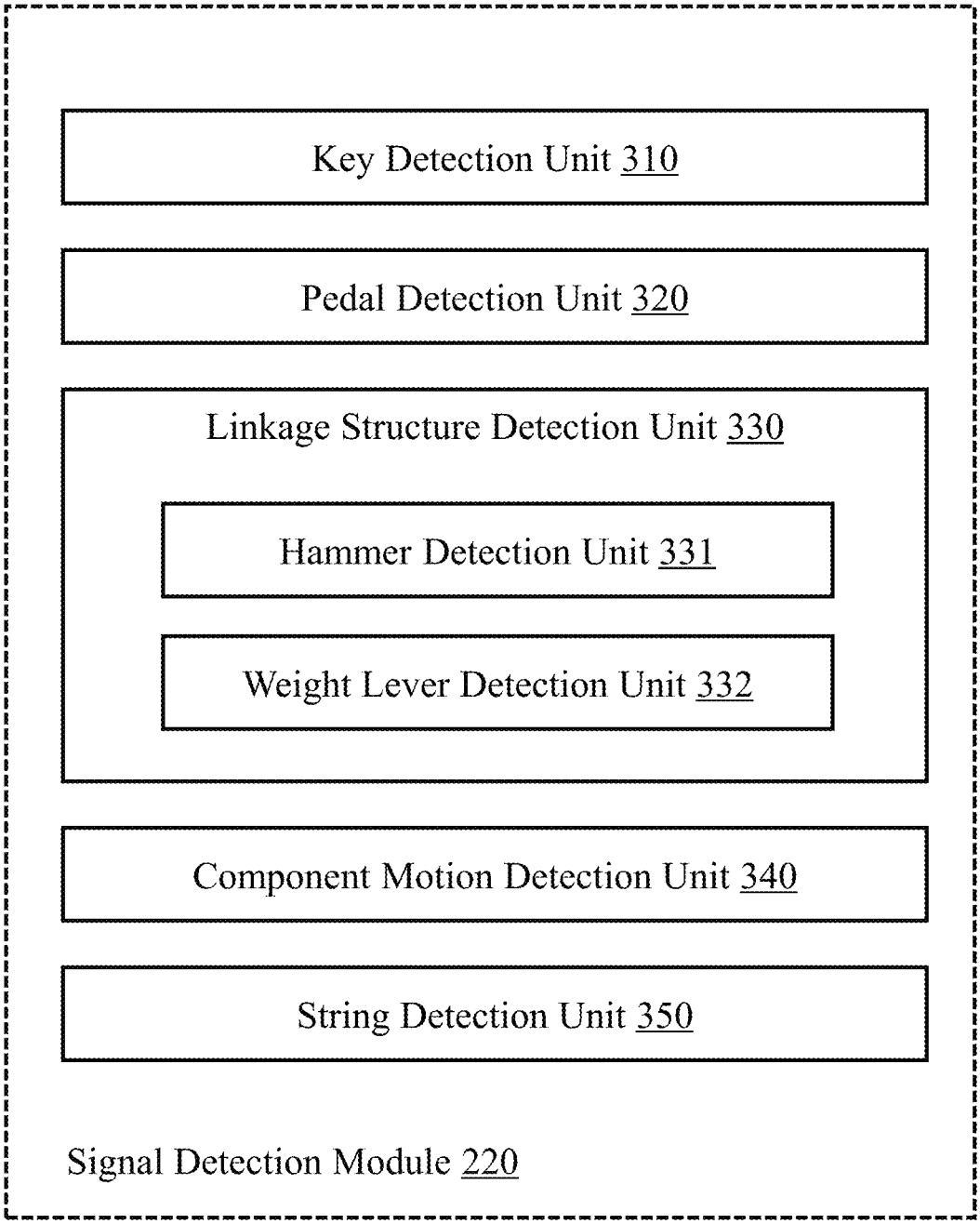
FIG. 3 is a block diagram illustrating an exemplary signal detection module according to some embodiments of the present disclosure.

FIG. 3 is a block diagram illustrating an exemplary signal detection module according to some embodiments of the present disclosure. The signal detection module 220 may be configured to detect various events that may be used to track (or record) user performance. The signal detection module 220 may include a key detection unit 310, a pedal detection unit 320, a linkage structure detection unit 330, a component motion detection unit 340, and a string detection unit 350. Some other detection units that can implement similar functions may be contained in the signal detection module 220 and not shown in the figure. In some embodiments, various detection units may detect different detection signals.

The key detection unit 310 may be configured to detect one or more events caused by the keyboard of the keyboard instrument system 100 The events caused by the keyboard may be motion events of the keys. The sensor 160 (e.g., a motion sensor) may be configured to detect the motion events. Exemplary motion sensor may include a pressure sensor chip, Hall element, electro-optical sensor, or the like, or a combination thereof. The position of the sensor(s) 160 may be determined according to the types of sensors. For instance, an electro-optical sensor (a type of motion sensors) may be placed under or near the keys of the keyboard to detect the key motion of the keys. A sensor 160 may be positioned corresponding to each of the plurality of keys of the keyboard instrument system 100. In some embodiments, a sensor 160 may detect events caused by the motions of two or more keys and may not be able to distinguish the difference between the two or more keys. For example, two adjacent keys may correspond to one motion detection sensor. The events caused by the two adjacent keys may correspond to a same sound. As such, the music file generated according to the signals detected by the sensor(s) 160 may be a simplified version of the performance by the user.

The pedal detection unit 320 may be configured to detect one or more events caused by the pedals. When the pedal is actuated, its movement (and the information related to the movement such as the speed, the distance the pedal travels, and the force applied on the pedal) may be detected by a sensor 160. The changes in the characteristics of the pedal may contain information of the performance by the user. The music file may contain the pedal performance information accordingly.

The linkage structure detection unit 330 may include a hammer detection unit 331 and a weight lever detection unit 332. The hammer detection unit 331 may be configured to detect one or more events caused by the hammers. The mechanical movement of keys and/or pedals may cause the movement of the corresponding hammers. Therefore, the movement of the hammers may contain the information related to the user's performance. Detecting the events caused by the hammer may be used to collect user performance information. The hammer detection unit 331 may detect various events caused by the hammers. Exemplary events caused by a hammer may include the velocity of the hammer movement, striking strength of the hammer, time duration of the movement, movement frequency, of the like, or a combination thereof. The hammer detection unit 331 may include one or more sensors 160, which may be positioned on or external to the hammers and/or the strings. For example, an electro-optical sensor (a type of motion detection sensors) may reside between a hammer and a corresponding string. In response to the hammer striking the string, the electro-optical sensor may detect the striking event caused by the hammer and generate a signal accordingly. As another example, a strength detection sensor may be positioned on or external to the hammer and/or on the string. In response to a hammer striking a string, the strength detection sensor may detect the strength of the striking and generate a signal accordingly. In some embodiments, the sensors 160 may be added to a traditional keyboard instrument.

The weight lever detection unit 332 may be configured to detect one or more events caused by weight levers. Like the hammer in the traditional keyboard instrument, the mechanical motion of the keys may be conducted to the weight levers via mechanical structures. By detecting the events caused by the weight levers, the user performance information may be detected similarly. The sensors 160 included in the weight lever detection unit 332 may be similar to the sensors 160 included in the hammer detection unit 331. In some embodiments, the sensors 160 may be integrated with the weight lever. For example, the sensor 160 may be inside the weight lever, during the manufacture of the weight lever. As a result, this type of assembling of the sensors 160 may be more stable. In some embodiments, the sensors 160 may be integrated with an elastic structure. The elastic structure may be used as a rebounding structure where a weight lever strikes on. Usually, the elastic structure may rebound the weight lever to simulate similar striking feeling in the traditional keyboard instrument. In some embodiments, some traditional keyboard instruments may be reconstructed to be compatible with normal striking mode and strike simulation mode. In normal striking mode, the hammers may strike the string to generate sound. In strike simulation mode, the hammers may strike the elastic structure, which may not generate sound. Examples of the two modes are described as described elsewhere in this disclosure (e.g., in connection with FIG. 12).

The component motion detection unit 340 may be configured to detect one or more events caused by motion conduction components of the keyboard instrument system 100. The motion conduction components may include components in the keyboard instrument system 100 that can conduct the mechanical motions of the keys and/or the pedals to the linkage structures. During the conduction, status change of the motion conduction components may be in response to the key pressing by the user, and may contain performance information. Detecting events relating to this type of status change may also be used to record user performance.

The string detection unit 350 may be configured to detect one or more events caused by the string. A vibration of a string may be generated in response to a hammer striking on the string. Since the mechanical motion of the hammer may contain performance information, the vibration of the string may also contain performance information because of the strike by the hammer. The events caused by the vibration of the string may be detected by the string detection unit 350 for recording user performance. The sensors 160 included in the string detection unit 350 may be positioned on and/or near the string. In some embodiments, the sensors 160 positioned on the string may not affect the quality of the sound generated by the string. In some embodiments, if the sensors 160 are positioned on the string, the vibration parameters of the string may be changed. Sound generated by the string may be changed accordingly. As such, the sensors 160 may be positioned near the string.

It should be noted that the signal detection module 220 described above is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure. Some modules may be removed from the signal detection module 220. For example, the pedal detection unit 320 may be included when the signal detection module 220 belongs to a piano system. The weight lever detection unit 332 may be included when the signal detection module 220 belongs to an electrical keyboard instrument system. In some embodiments, not all the units are needed. A part or all of the units may implement the functions of the signal detection module 220.

Figure 12:
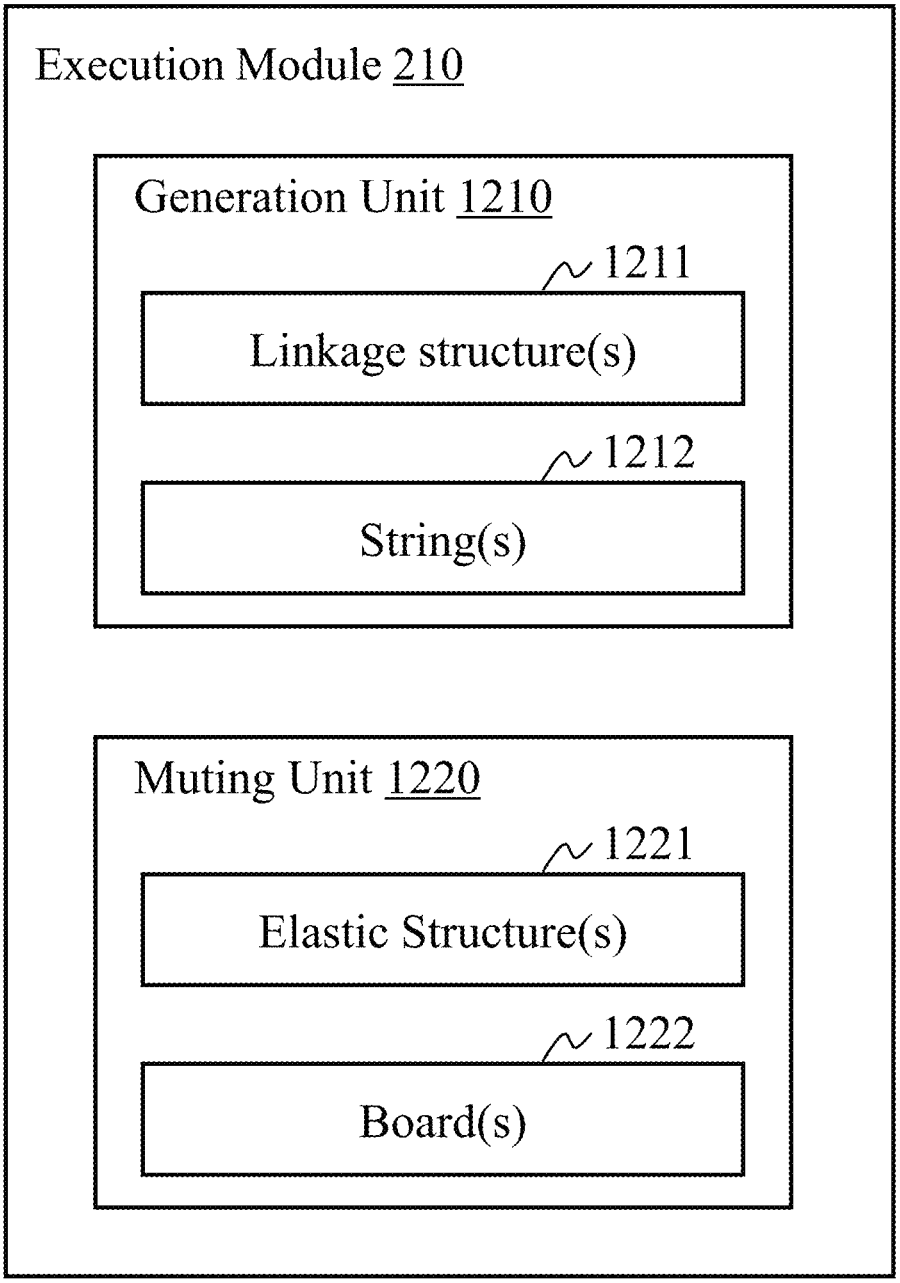
FIG. 12 is a block diagram illustrating an exemplary execution module according to some embodiments of the present disclosure.

FIG. 12 is a block diagram illustrating an exemplary execution module 210 according to some embodiments of the present disclosure. The execution module 210 may include a generation unit 1210, a muting unit 1220, and/or any other suitable component for producing sounds in the keyboard instrument system 100.

In some embodiments, the generation unit 1210 may generate sounds when a user plays the keyboard instrument system 100. In some embodiments, the generation unit 1210 may include one or more linkage structures 1211 and strings 1212. The linkage structure 1211 may include a link and a block. The Block may be in connection with one end of the link. Each linkage structure 1211 may be associated with one or more keys of the keyboard instrument system 100. The other end of the link of the linkage structure 1211 may be in connection with the one or more keys of the keyboard instrument system 100. The linkage structure 1211 may be positioned at a resting position when its corresponding key is not depressed. When a user depresses the key, the linkage structure 1211 may move towards the string 1212 from the resting position. The linkage structure 1211 may strike the string 1212 at a speed (e.g., several meters per second). The string 1212 may vibrate to generate a sound. As will be discussed in connection with FIGS. 14-A and 14-B, linkage structure(s) 1211 may include linkage structures 1211*a*-1211*n* and strings 1212 may include strings 1212*a*-1212*n*.

The muting unit 1220 can provide one or more muting functions for the keyboard instrument system 100. For example, the muting unit 1220 can reduce the volume of sounds produced by the keyboard instrument system 100 (e.g., sounds produced by generation unit 1210). As another example, the muting unit 1220 can mute one or more portions of the generation unit 1210. More particularly, for example, the muting unit 1220 can prevent generation of sounds by one or more strings of the generation unit 1210. In some embodiments, the muting functions can be implemented by preventing interactions between one or more strings and their corresponding linkage structures (e.g., by preventing the strings from being impacted by the linkage structures 1211).

In some embodiments, muting unit 1220 may include one or more elastic structures 1221, boards 1222, and/or any other component for implementing muting functions. In some embodiments, each of the elastic structures 1221 may include one or more springs, such as springs 1231*a*-1231*n* illustrated in FIG. 14-A. In some embodiments, each of the elastic structures 1221 may include one or more elastic strips, such as elastic strips 1241*a*-1241*n* illustrated in FIG. 14-B. In some embodiments, the muting unit 1220 may be operationally coupled to a switch. In some embodiments, when the switch is switched to a particular working mode of the keyboard instrument system 100, positioning information of one or more components of muting unit 1220 (e.g., the location, direction, and/or orientation) may be adjusted to implement the working mode. In some embodiments, the muting unit 1220 may be movable or detachable from the keyboard instrument system 100.

The elastic structure 1221 may be elastic. The length, shape, and/or volume of the elastic structure 1221 may be reduced or compressed when the elastic structure 1221 is struck by the linkage structure 1211. The elastic structure 1221 may include one or more springs (e.g., springs 1231*a*-1231*n* as illustrated in FIG. 14-A), elastic strips (e.g., elastic strips 1241*a*-1241*n* as illustrated in FIG. 14-B), elastic buffers, etc. Exemplary springs may include a coil spring, a flat spring, a machined spring, a serpentine spring, a tension spring, a torsion spring, a coil spring, a flat spring, a serpentine spring, a helical spring, a leaf spring, a gas spring, a torsion spring, a wave spring, or the like, or a combination thereof. The elastic structure 1221 may be made of any suitable material, such as, metal/alloy (e.g., steel, copper, aluminum, any alloy, etc.), polymers (e.g., rubbers, polybutadiene, nitrile rubber, etc.), composite materials (e.g., cork, metal-carbon fiber composite, composite ceramic and metal matrices, fiber-reinforced polymers, etc.), etc. The elastic structure 1221 can have any suitable shape. For example, the elastic structure 1221 may have a two-dimensional shape (e.g., triangular, square, rectangular, circular, etc.), a three-dimensional shape (e.g., hollow sphere, hollow cube, coiled tube, etc.), or the like.

The board 1222 may be a housing in which the elastic structures 1221 are mounted. The board 1222 may be made of a variety of materials, such as, metals, plastics, wood, pottery, porcelain, ceramics, or the like, or any combination thereof. In some embodiments, the board may have an oblong shape with a substantially uniform thickness.

In some embodiments, the board 1222 may be placed at various positions to implement various working modes of the keyboard instrument system 100. For example, to implement the strike simulation mode, the board 1222 may be placed at a first position between the linkage structure(s) 1211 and the string(s) 1212 to prevent interactions between the linkage structure(s) 1211 and the string(s) 1212. More particularly, for example, the board at the first position may intercept the linkage structure(s) 1211 before it strikes the string(s) 1212. When a user depresses a key, the linkage structure(s) 1211 may move towards the string(s) 1212. The linkage structure(s) 1211 may strike the elastic structure(s) 1221 mounted on the board 1222, generating a sound. The generated sound may be quieter than a sound generated when the linkage structure(s) 1211 strikes the string(s) 1212. After the interaction with the elastic structure(s) 1221, the linkage structure(s) 1211 may move backward to its resting position.

As another example, to implement the normal striking mode other than the strike simulation mode, the board 1222 may be placed at a second position. In some embodiments, the second position is not located between the linkage structure(s) 1211 and the string(s) 1212. As such, string(s) 1212 may be accessible by the linkage structure(s) 1211. More particularly, for example, when a user depresses a key, the linkage structure(s) 1211 may move towards the string(s) 1212 and may interact with the string(s) 1212 (e.g., by striking one or more strings 612). The string(s) 1212 may then vibrate and generate a sound. After the interaction, the linkage structure may move backward to its resting position.

In some embodiments, the board 1222 may be mechanically coupled with an action mechanism (not shown in the figures) that can cause the board to move between the positions and/or to be located at one or more of the positions. In some embodiments, the action mechanism may be and/or include a gear, an arm, a lock, or the like, or any combination thereof. In some embodiments, the action mechanism may be operationally coupled to the switch. When a working mode is selected using the switch, the switch can cause the action mechanism to place the board 1222 at one or more positions to implement the selected working mode.

Figure 13:
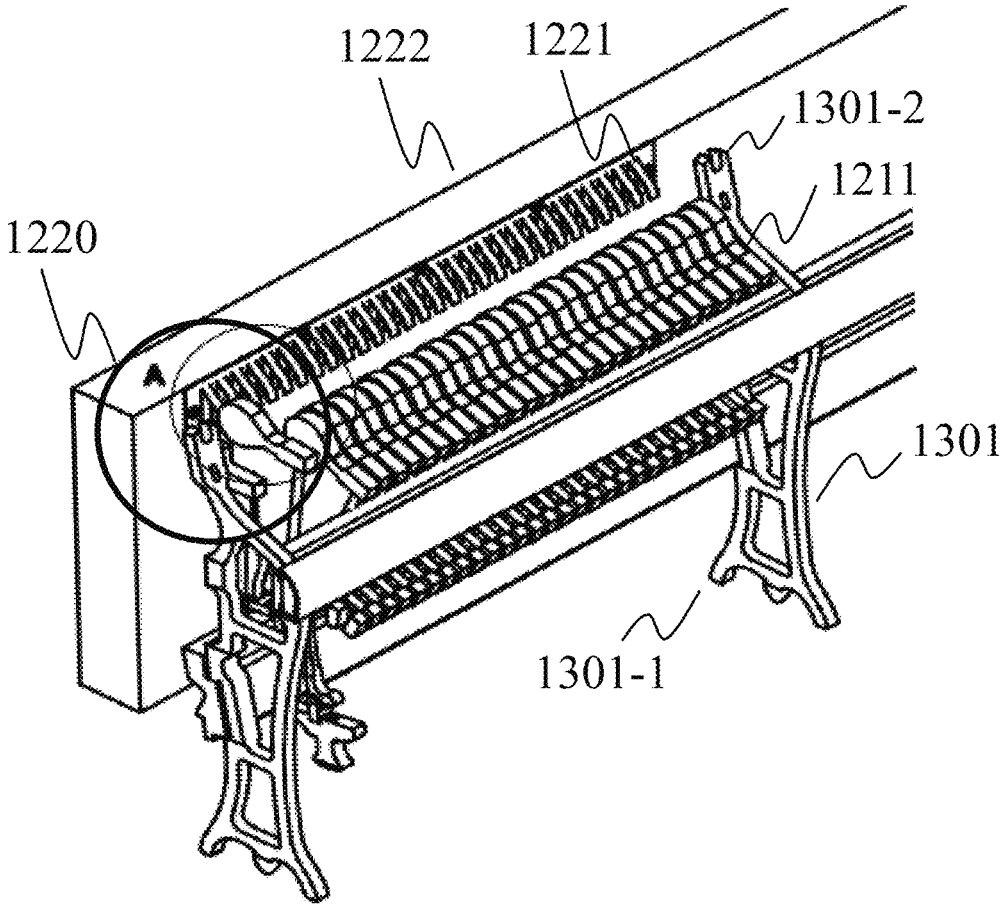
FIG. 13 is a diagram illustrating an exemplary execution module according to some embodiments of the present disclosure.

FIG. 13 is a diagram illustrating an exemplary execution module 210 implementing a strike simulation mode according to some embodiments of the present disclosure. In some embodiments, to implement the strike simulation mode, one or more components of muting unit 1220 may be positioned between the strings 1212 (not shown in FIG. 13) and linkage structures 1211. For example, in the strike simulation mode, the elastic structure 1221 mounted on the board 1222 may be positioned between the strings 1212 and linkage structures 1211. In some embodiments, the elastic structure 1221 may be positioned close to the linkage structures 1211 in a trajectory of the linkage structures 1211 moving towards the strings 1212. Furthermore, one or more legs 1301 may be provided to keep the linkage structures 1211 in balance. In some embodiments, one end 1301-1 of the leg 1301 may be in contact with the ground. Another end 1301-2 of the leg 1301 may be fixed with the board 1222 of the muting unit 1220.

FIGS. 14-A and 14-B illustrate examples of execution module 210 and muting unit 1220 implementing the strike simulation mode according to some embodiments of the present disclosure. As illustrated in FIG. 14-A, the elastic structures may include one or more springs 1231*a*-1231*n* and one or more boards 1222. To implement the silent mode, the muting unit 1220 may be placed in a first position between the linkage structures 1211*a*-1211*n* and strings 1212*a*-1212*n*. The springs 1231*a*-1231*n* may be included in the elastic structure 1221. The springs 1231*a*-1231*n* may or may not be connected with each other. The springs 1231*a*-1231*n* may or may not be evenly spaced. In some embodiments, one or more trestles 1402 may support the board(s) 1222. One or more linkage structures 1211*a*-1211*n* may correspond to one or more strings (1212*a*-1212*n*). For example, one linkage structure (e.g., 1211*a*) may correspond to one string (e.g., 1212*a*). In some embodiments, one linkage structure (e.g., 1211*a*) may correspond to multiple strings (e.g., 1212*a*-1212*n*). In some embodiments, each of linkage structures 1211*a*-1211*n* may correspond to one or more springs 1231*a*-1231*n*. For example, a linkage structure (e.g., 1211*a*) may be associated with one spring (e.g., 1231*a*). In some embodiments, a linkage structure (e.g., 1211*a*) may correspond to multiple springs (e.g., 1231*a*-1231*n*).

In some embodiments, each of springs 1231*a*-1231*n* may be compressed from its equilibrium length when struck by one or more linkage structures 1211*a*-1211*n*. The equilibrium length generally refers to the length of a spring when the spring is free of external forces. As a result of the compression, the springs (e.g., 1231*a*-1231*n*) may exert a restoring force with a direction opposite to the compression. The strength of the restoring force may depend on the compression relating to the springs (e.g., 1231*a*-1231*n*). For example, the restoring force may be determined based on the Hooke's Law. More particularly, for example, the restoring force may be linearly proportional to the length variation from the compressed length of a spring (e.g., 1231*a*) to its equilibrium length. The ratio between the restoring force and the length variation may be referred to as a "force constant." In some embodiments, the force constant of the elastic structure 1221 may be set by adjusting one or more features of the elastic structure 1221 and/or the springs 1231*a*-1231*n*, such as the dimension, shape, structure, and/or material of the elastic structure 1221 and/or springs 1231*a*-1231*n*. In some embodiments, elastic structure 1221 may include one or more elastic strips 1241*a*-1241*n* as illustrated in FIG. 14-B. The force constant may be set by adjusting the shape, dimension, and/or any other feature of the springs 1231*a*-1231*n* or elastic strips 1241*a*-1241*n*. For example, the elastic trips 1241*a*-1241*n* may be configured in a V-shaped formation. As another example, the springs 1231*a*-1231*n* may be in the shape of a coiled tube, generated by sweeping a circle about the path of a helix.

As shown in FIG. 14-B, the muting unit 1220 may include one or more elastic structures 1221, each of which may further include one or more elastic strips 1241*a*-1241*n*. The components of the keyboard instrument system 100 may be arranged as illustrated in FIG. 14-A. In some embodiments, the elastic strips 1241*a*-1241*n* may be positioned between the strings 1212*a*-1212*n* and the linkage structures 1211*a*-1211*n* in the strike simulation mode. In some embodiments, the elastic strips 1241*a*-1241*n* may be straight or curved. The elastic strips may generate a restoring force when interacting with and/or compressed by the linkage structures 1211*a*-1211*n*, and the linkage structures 1211*a*-1211*n* may rebound as a result of the restoring force. In some embodiments, the strike simulation mode may be implemented using one or more mechanisms described in connection with FIGS. 15-A and 15-B.

FIGS. 15-A and 15-B are diagrams illustrating mechanisms for implementing an exemplary execution module 210 in the strike simulation mode according to some embodiments of the present disclosure. As illustrated in FIG. 15-A, to implement the strike simulation mode, the board 1222 mounting the spring 1221 may be positioned between the string 1212 and the linkage structure 1211. When the linkage structure 1211 is at a resting position, the spring 1221 may be separated from the linkage structure 1211 by an initial distance of $L_1$. The string 1212 may be parallel to the board 1222 with a distance of $L_2$. One or more sensors (e.g., one or more sensors 160) may be configured to acquire information relating to one or more parameters related to the string 1212 and/or the linkage structure 1211, such as pressure, speed, acceleration, etc. In some embodiments, the sensors 160 may acquire pressure information on the linkage structure 1211. In some embodiments, the pressure information may relate to a force applied to a first component by a second component. For example, the pressure information may include information about a pressure acted on an elastic structure 1221 (e.g., springs 1231*a*-1231*n*, elastic strips 1241*a*-1241*n*, etc.) by a linkage structure. The sensors may be positioned and/or arranged in any suitable manner to detect the motion information. For example, one or more of the sensors 160 can be positioned on the tip of the linkage structure(s) 1211. As another example, one or more of the sensors 160 may be positioned inside or on the surface of the elastic structure 1221 (e.g., springs 1231*a*-1231*n*, elastic strips 1241*a*-1241*n*, etc.) or the board 1222.

When a user presses a key in the keyboard, the force may be transmitted to a linkage structure 1211, and the linkage structure 1211 may move towards the elastic structure 1221 on the board 1222. The linkage structure may strike on the elastic structure 1221 at a velocity of $V_h$. The striking impact may cause the linkage structure to stop, and the elastic structure 1221 may be compressed or deformed. The compression may be maximum when the linkage structure 1211 stops moving and elastic structure 1221 stop deforming. After the maximal compression, the elastic structure 1221 may rebound and push the linkage structure 1211 back. The linkage structure 1211 may move backward to its original position.

As illustrated in FIG. 15-B, when the linkage structure 1211 strikes the elastic structure 1221, the elastic structure 1221 may be compressed along its axial direction. When the elastic structure 1221 stops being compressed, its compression may be the maximum. The distance between compressed elastic structure 1221 and the linkage structure 1211 may be $L_1'$, which may be greater than the length $L_1$. The difference between the two distances $L_1$ and $L_1'$ may be denoted as $\Delta L_1$, which may indicate the compressed length of the elastic structure 1221 (i.e., the displacement). As the result of compression, the elastic structure 1221 may exert a restoring force on the linkage structure 1211. The restoring force may cause the linkage structure 1211 to move backward to its original position. The restoring force may be further transmitted to the key associated with the linkage structure 1211 and cause the user to feel the resilient linkage structure 1211. The sensor 160 may acquire information related to the pressure before, during, and/or after the impact. The acquired information may be used by the processor 120 to generate one or more parameters relating to the impact.

In some embodiments, the restoring force of the elastic structure 1221 may be determined according to equation (1) shown below:

$$F_r = k \times \Delta L_1 \quad (1),$$

where $F_r$ refers to the restoring force, k refers to the force constant of the elastic structure 1221, and ΔL1 refers to the displacement. The displacement $\Delta L_1$ may be a distance by which the elastic structure 1221 is extended or compressed by the restoring force $F_r$. For example, the displacement ΔL1 may be a difference between the compressed length of an elastic structure 1221 and its equilibrium length.

The length variation may depend on the velocity $V_h$ of the linkage structure 1211. In some embodiments, the displacement $\Delta L_1$, may be calculated according to equation (2):

$$\Delta L_1 = V_h\left(\frac{M_h}{k}\right)^{1/2}, \quad (2)$$

where $V_h$ refers to the elastic structure 1221 and $M_h$ refers to the mass of the linkage structure 1211.

On the basis of equations (1) and (2), the restoring force $F_r$ may be determined according to equation (3):

$$F_r = kV_h\left(\frac{M_h}{k}\right)^{1/2} = V_h(kM_h)^{1/2}. \quad (3)$$

According to equation (3), the restoring force may depend on the velocity of the linkage structure 1211 and the force constant of the elastic structure 1221. An elastic structure 1221 having a greater force constant k may exert a greater restoring force. A greater restoring force may cause the user to feel stronger rebound when releasing the key.

In some embodiments, the distance Li between the elastic structure 1221 and the linkage structure 1211 may be set or adjusted according to the force constant of the elastic structure 1221. In some embodiments, the distance between the board 1222 and the linkage structure 1211 may be set or adjusted according to the force constant of the elastic structure 1221.

Figure 4:
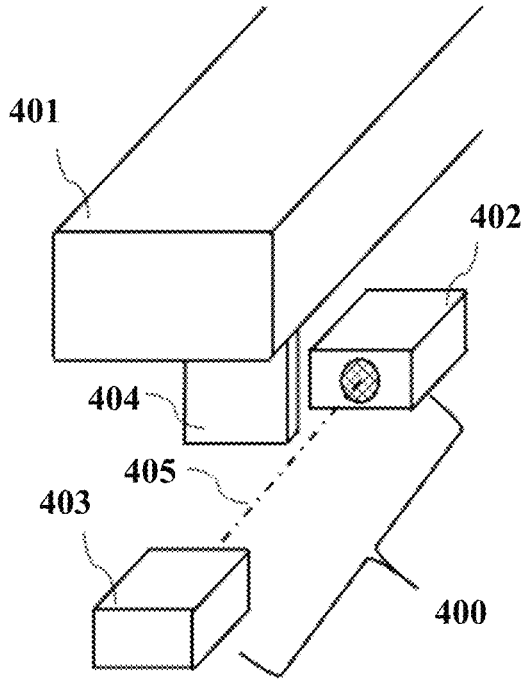
FIG. 4 is a schematic diagram illustrating an exemplary key motion detection structure according to some embodiments of the present disclosure.

FIG. 4 is a schematic diagram illustrating an exemplary key motion detection structure according to some embodiments of the present disclosure. Mechanisms for detecting motions of a key of a keyboard instrument using a sensor are illustrated. A sensor may be positioned under a key to detect the motion of the key. As shown in FIG. 4, the sensor 400 (e.g., an electro-optical sensor) may include a light-emitting element 402 and a light-detecting element 403. The light-emitting element 402 may include visible light-emitting (LED), laser LED, infrared LED, laser diode (LD), or photocell, or alike, or a combination thereof. The light-detecting element 403 may include phototube, active-pixel sensor (APS), bolometer, charge-coupled device (CCD), gaseous ionization detector, photoresistor, phototransistor, or alike, or a combination thereof. The light-emitting element 402 may generate light having various wavelengths. For example, the light-emitting element 402 may generate visible light, infrared light, ultraviolet (UV) light, etc. In some embodiments, the wavelength of the light emitted by the light-emitting element 402 may be controlled by one or more motors using a Pulse Width Modulation (PWM) mechanism. The light-detecting element 403 may be configured to receive the light and to convert it into an electronic signal (e.g., a current signal, a voltage signal, etc.).

In some embodiments, the light-emitting element 402 and the light-detecting element 403 may be positioned under the key 401. In some embodiments, a non-transparent extrusion (e.g., a plate 404) may be mounted to the surface of the key 401. The plate 404 may block the light emitted by the light-emitting element 402 reaching to the light-detecting element 403. The plate 404 may be mounted to the lower surface of the key 401 (e.g., the bottom of the key 401). The light-emitting element 402 may constantly emit light pointing to the light-detecting element 403. Alternatively, the light-emitting element 402 may also discontinuously emit light. For instance, there may be a certain waiting period between two light emissions. The waiting period may be adjusted by the control unit 241 according to the frequency of the user's pressing the keys.

In some embodiments, the light-emitting element 402 may emit a light beam 405. When the key 401 is not pressed down, the key 401 stays at a "top" position. When a user presses the key 401, the key may move downwards from the "top" position. When the key 401 does not go further, it reaches an "end" position. The plate 404 may move along with the key 401 and may block all or part of the light beam 405. The amount of the light detected by the light-detecting element 403 may vary due to the movement and position of the non-transparent plate 404. For example, when the key 401 moves toward the "end" position and blocks at least part of the light beam 405, the amount of light detected by the light-detecting element 403 may decrease. As another example, when the key 401 moves toward the "top" position, the amount of light detected by the light-detecting element 403 may increase. The light-detecting element 403 can determine information about the amount of the received light over time and can convert such information into one or more electronic signals (e.g., one or more key signals).

Figure 5:
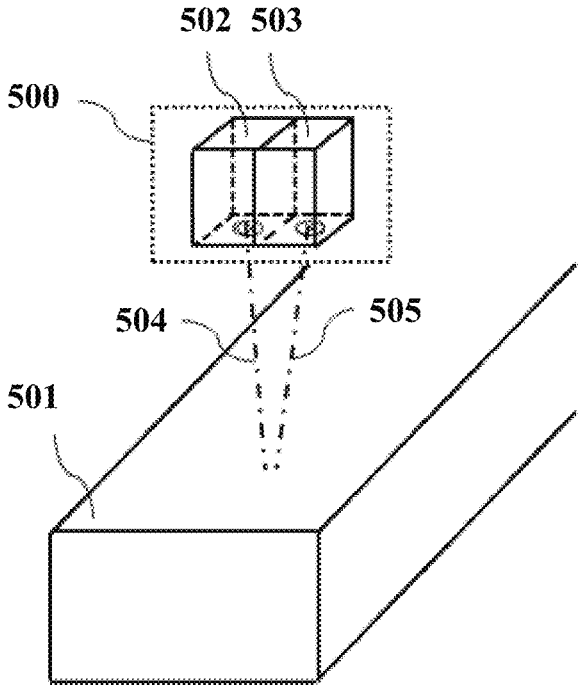
FIG. 5 is a schematic diagram illustrating an exemplary key motion detection structure according to some embodiments of the present disclosure.

FIG. 5 is a schematic diagram illustrating an exemplary key motion detection structure according to some embodiments of the present disclosure. The components in FIG. 5 may have the same structure as those in FIG. 4 except for the configurations. In some embodiments, the plate 404 may be omitted. The light-emitting element 502 and the light-detecting element 503 may be placed above or beneath the key 501, and the light beam 504 emitted by the light-emitting element 502 may not be able to travel directly pointing to the light-detecting element 503. The light beam 504 may point to and be reflected by the key 501. The reflected light 505 may then travel pointing to the light-detecting element 503 and may be received by the light-detecting element 503. When a user presses the key 501, the key may move downwards from the "top" position to the "end" position. The distance that the light beam 504 travels from the light-emitting element 502 to the light-detecting element 503 may depend on the movement of the key 501. For example, when the key 501 is pressed, the distance between the sensor 500 and the key 501 may change. The traveling distance of the beam 504 may change accordingly. The light-detecting element 503 may determine the time between light emission and light reception to record the change in distance that the light beam 504 travels. The change in distance may be converted into one or more electric signals by the light-detecting element 503. Thus, the motions of the key 501 may be recorded by the sensor 500.

The light-emitting elements and the light-detecting elements described above are not exhaustive and are not limiting. Numerous other changes, substitutions, variations, alterations, and modifications may be ascertained to one skilled in the art and it is intended that the present disclosure encompass all such changes, substitutions, variations, alterations, and modifications as falling within the scope of the present disclosure.

FIGS. 6A-D illustrate exemplary configurations of linkage structure detection sensors according to some embodiments of the present disclosure. As shown in the figures, the keyboard instrument system 100 may include a linkage structure 613 configured to strike a string to generate sound or strike on an elastic structure to simulate the rebound force by a hammer. The keyboard instrument system 100 may include a rebound device 611 may be a string or an elastic structure of the keyboard instrument system 100. In some embodiments, the linkage structure 613 may be a hammer, and the rebound device 611 may be a string of a traditional keyboard instrument. The hammer may be actuated by the user to strike on the string to generate sound. In some embodiments, the linkage structure 613 may be a weight lever and rebound device 611 is an elastic structure. The strike by the linkage structure on the rebound device 611 may be used to simulate actual rebound feeling like that in the traditional keyboard instrument, which may not generate sound. In this case, the material or structure of the rebound device 611 may need to have elasticity to make the simulation close to real rebound feeling.

Figure 6A:
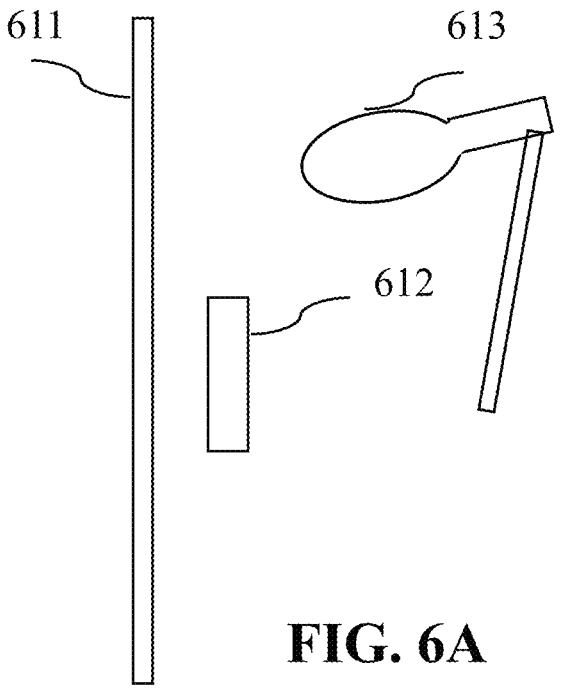
FIGS. 6A-D illustrate examples of exemplary configurations of linkage structure detection sensors according to some embodiments of the present disclosure.

In some embodiments, the configuration of sensors 612 may affect the sound generated. For example, in a traditional keyboard instrument, a sensor 612 configured on a hammer may cause weight change of the hammer and may further affect the strength of the strike by the hammer on the corresponding string. As another example, a sensor 612 configured on a string may cause frequency parameter change of the string and may further affect the vibration frequency in response to a striking. In this case, non-contact between the sensor 612 and the linkage structure 613 or the rebound device 611 may be preferred. FIG. 6A illustrates an exemplary non-contact configuration of the sensor 612. The sensor 612 may be an electro-optical sensor and positioned below the hammer. The movement of the hammer may be detected by the sensor 612. The detection method may be similar to that described above in connection with in FIGS. 4 and 5. In some embodiments, the sensor 612 may be a Hall sensor. The linkage structure 613 may need to be equipped with magnetic steel to provide magnetic field for the Hall sensor. In some embodiments, the sensor 612 may be an ultrasonic sensor. The ultrasonic sensor may include a sound wave emitter and a sound wave receiver. The movement of the linkage structure may affect the sound wave received by the sound waver receiver. Accordingly, the user performance information may be recorded. The configuration of the ultrasonic sensor may be near the linkage structure 613, but not interfere the movement of the linkage structure 613.

Figure 6B:
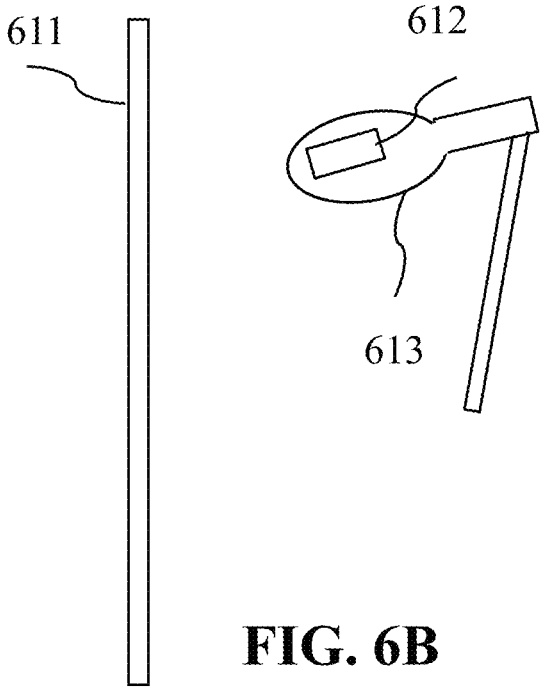
Figure 6C:
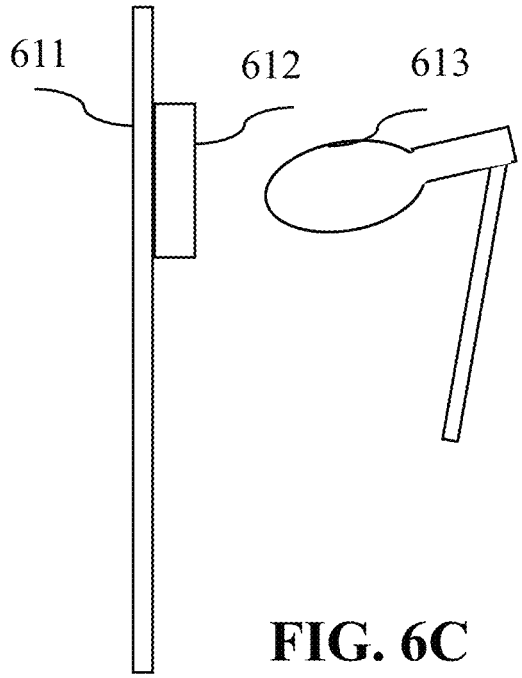

In some embodiments, the linkage structure 613 may be a weight lever and the rebound device 611 may be an elastic structure. The configuration of the sensor 612 may not affect the sound generation because the sound may be generated by an electrical sound box (not shown in the figure). In this case, integration of the sensor 612 with the linkage structure 613 may help detect the motion of the linkage structure 613 more accurately. FIGS. 6B and 6C illustrate exemplary integration configurations of the sensor 612. In FIG. 6B, the sensor 612 may be set inside the linkage structure 613 (e.g. a weight lever). The effect of the weight change caused by the sensor 612 may be overcome by taking the weight of the sensor 612 into consideration during designing of the linkage structure 613. In this case, the sensor 612 may be used to detect velocity, acceleration, or vibration parameters of the linkage structure 613 when a striking event occurs. In FIG. 6C, the sensor 612 may be positioned on the rebound device 611 facing the linkage structure 613. If the linkage structure 613 strikes the rebound device 611, l it may first strike the sensor 612. And then vibrations may be conducted to the rebound device 611. Then the linkage structure 613 may be rebounded. The sensor 612 may detect the striking strength and record the time information related to the striking.

Figure 6D:
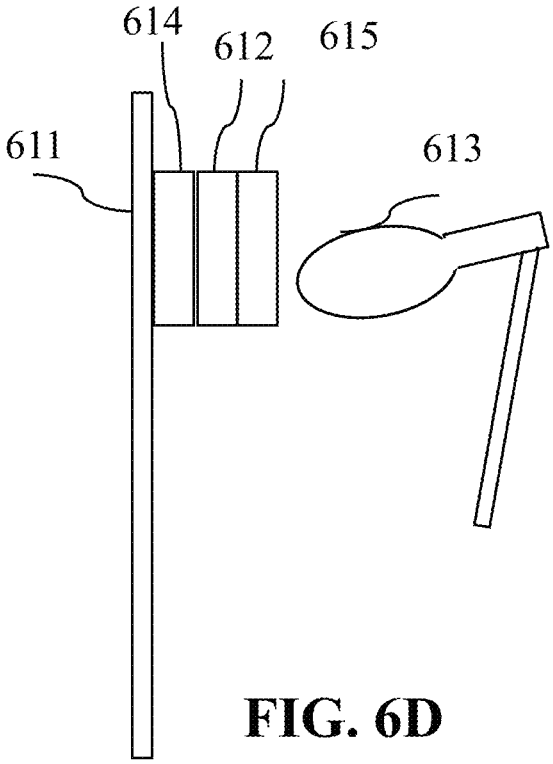

FIG. 6D illustrates an exemplary configuration of the sensor 612 similar to FIG. 6C. The sensor 612 may not be in contact with the rebound device directly. A buffer layer 614 may reside between the sensor 612 and the rebound device 611. In some embodiments, the sensor 612 may include two or more sensors (although FIG. 6D only illustrates one sensor 612). For example, the sensor 612 may include a first sensor and a second sensor, which may be positioned next to or near each other. The linkage structure 613 may strike on a first sensor 612, and the vibration generated by the striking may be conducted via the rebound device 611. A second sensor may detect the vibration conducted by the rebound device 611. The vibration detected by the second sensor 612 may be considered as an interference event that not expected to detect. The buffer layer 614 may be configured to decrease or eliminate the vibration conducted through the rebound device 611. In some embodiments, the sensor 612 may be a commonly used sensor that is not designed for the keyboard instrument system 100. Therefore, the elasticity of the sensor 612 may not be enough for rebounding the linkage structure 613. Or for some other reason, for example, the safety use of the sensor 612, the sensor 612 may not be stroke directly by the linkage structure 613. In this case, a vibration conduction layer 615 may be introduced to solve the problems. Accordingly, the material of the vibration conduction layer 615 may include an elastic material that can simulate real string to rebound the linkage structure 613. The vibration may be conducted to the sensor 612 via the vibration conduction layer 615. The intensity of the vibration may be adjusted by adjusting parameters of the vibration conduction layer 615. Exemplary parameters of the vibration conduction layer 615 may include size, material, or the like.

In some embodiments, the rebound force by the rebound device in response to a striking by the linkage structure 613 may vary for different keys of the keyboard instrument system 100. For example, in a traditional piano, the rebound force by a string in response to a striking by a hammer may be determined based on certain parameters (e.g., radial, length, material) of the string. For different keys, the rebound force conduct to the keys via the hammers may be different. To simulate the real rebound feeling in the traditional piano, some characteristics of the components of the keyboard instrument system 100 may be adjusted. For example, the characteristics of the rebound device 611, the linkage structure 613, the buffer layer 614, and the vibration conduction layer 615 may be changeable during assembling the keyboard instrument system 100. In the bass zone of the keyboard instrument system 100, the rebound feeling conducted to the keys of the bass zone may be softer comparing to the keys of a treble zone of the keyboard instrument 100. However, the rebound feeling conducted to the keys of the treble zone may be more clear-cut than the keys of the bass zone.

In some embodiments, the characteristics of the linkage structure 613 may be different. The characteristics of the linkage structure 613 may include weight, shape, material, or the like. For example, the weight of each weight lever may be different from each other. In a traditional piano, the weight of the hammer may decrease from the bass zone to the treble zone of the traditional piano. To simulate the traditional piano, the weight of the weight levers of the keyboard instrument system 100 may decrease from the bass zone to the treble zone either. For another example, the weight levers of the keyboard instrument system 100 may be classified into a plurality of groups. The weight of the weight levers in one group may be same. The weights of the groups of weight levers from bass zone to the treble zone may decrease.

In some embodiments, the characteristics of the rebound device 611 may be different. For example, parameters of the springs 1231*a*-1231*n* may be changeable to simulate real rebound feeling like a traditional piano. Exemplary parameters of the springs 1231*a*-1231*n* may include material, excursion, hardness, length, diameter, or the like, or a combination thereof. For example, in the bass zone of the keyboard instrument system 100, the diameter of the springs may be 0.8 mm. In the alto zone of the keyboard instrument system 100, the diameter of the springs may be 1.0 mm. In the treble zone of the keyboard instrument system 100, the diameter of the springs may be 0.8 mm.

In some embodiments, the characteristics of the buffer layer 614, and the vibration conduction layer 615 may be different. XXXXXXXXXXX It should be noted that the examples in FIG. 6A to FIG. 6D are provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure. Some components may be removed from the examples. For example, in FIG. 6D, the vibration conduction layer 615 and the buffer layer 614 may not be needed simultaneously. One of the two components may be removed in some examples.

Figure 7:
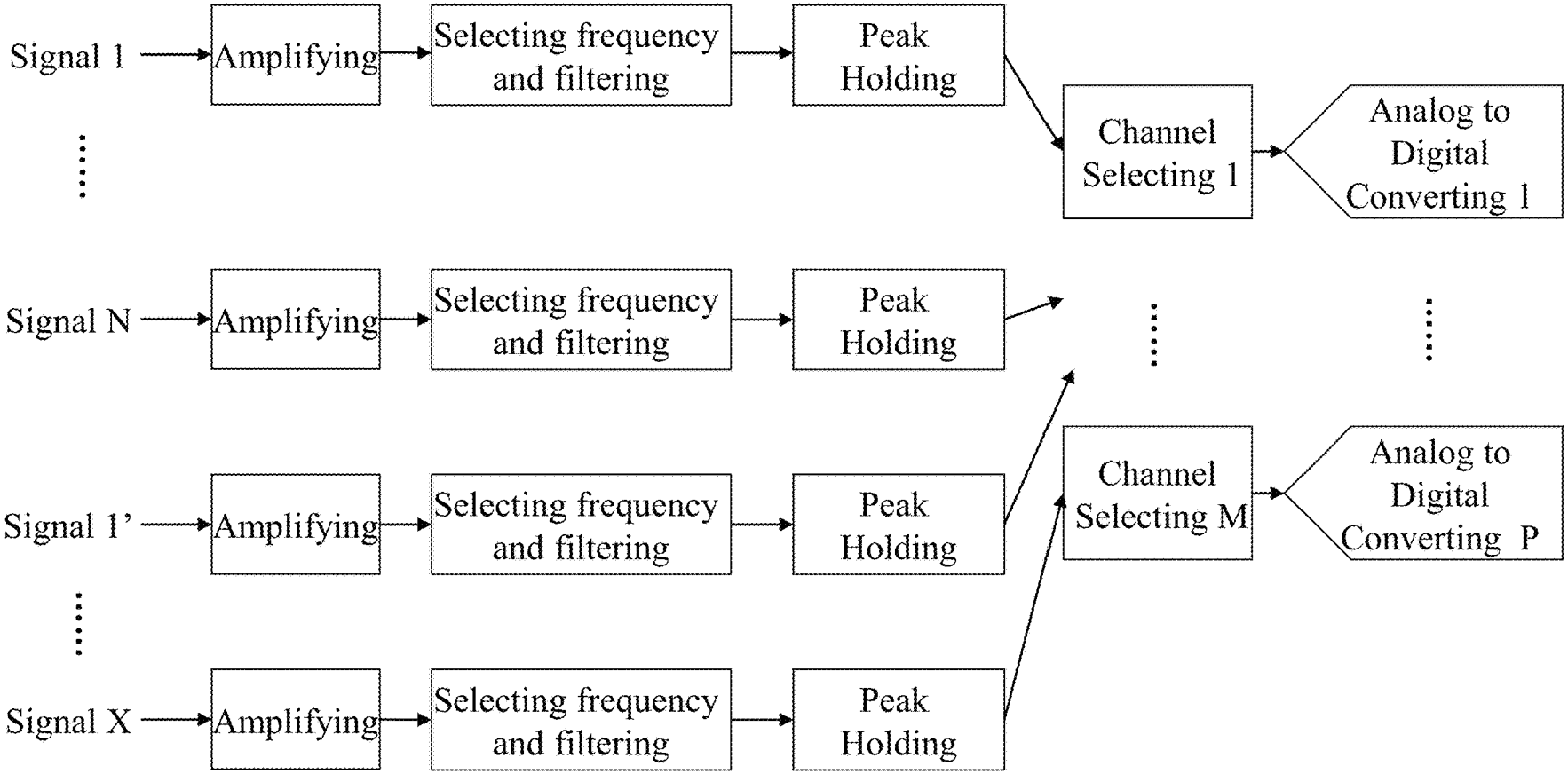
FIG. 7 is a schematic diagram illustrating an exemplary signal processing method according to some embodiments of the present disclosure.

FIG. 7 is a schematic diagram illustrating an exemplary signal processing method according to some embodiments of the present disclosure. As shown in the figure, a plurality of signals may be detected. The signals may be classified into two categories and numbered as 1 to N and 1' to X, respectively. In some embodiments, the signals 1 to N may be the signals generated by the sensors 160 corresponding to the plurality of linkage structures of the keyboard instrument system 100. In some embodiments, the number N may be equal to or less than the number of keys of the keyboard instrument system 100. For example, the number of keys of a piano may be eighty-eight, and the number N may be eighty-eight. In some embodiments, the signal 1'to X may be the signals generated by sensors 160 configured at extra positions. In some embodiments, the extra position may refer to a position that not corresponding to the plurality of linkage structures of the keyboard instrument system 100. For example, the position between two sensors 160 corresponding to hammers may be an extra position. No hammer may correspond to the sensor positioned at the extra position. However, the sensor 160 positioned at the extra position (as illustrated in FIG. 6D) may still detect vibrations conducted via the rebound device 611. The signals detected by the sensors 160 positioned at the extra positions may be further used to assess whether the signal is generated in response to an interference event. For example, three vibration intensity values may be included in three signals generated by three sensors 160. The three sensors 160 may include two adjacent sensors 160 corresponding to hammers and one sensor 160 positioned at the extra position between the two adjacent sensors 160. The three vibration intensity values may be analyzed according to a predetermined algorithm to determine whether the vibration detected by one of the two sensors corresponding to hammers is an interference event. The number of X may be zero or any positive integer. Several steps may be performed to process the signals, e.g. amplifying, selecting frequency and filtering, peak holding, or the like. The processing steps may be implemented by a circuit. The circuit may be integrated into each of the sensors. Then a channel selecting step may be performed by a plurality of channel selectors. The number of the channel selectors M may be equal to or less than the number of the sensors. For example, two or more sensors 160 may share one channel selector. After the channel is selected, an analog-to-digital converting step may be performed by one or more analog-to-digital converters. The number of the analog-to-digital converters P may be equal to or less than the number of the channel selectors M. For example, one or more analog-to-digital converters may be a multiway analog-to-digital converter. Multiple signals transmitted from the channel selectors may be sent to the multiway analog-to-digital converter.

It should be noted that the signal processing method described above for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure. For example, the signals 1' to X may not be necessary. The sequences steps of processing the signals may be adjusted.

Figure 8:
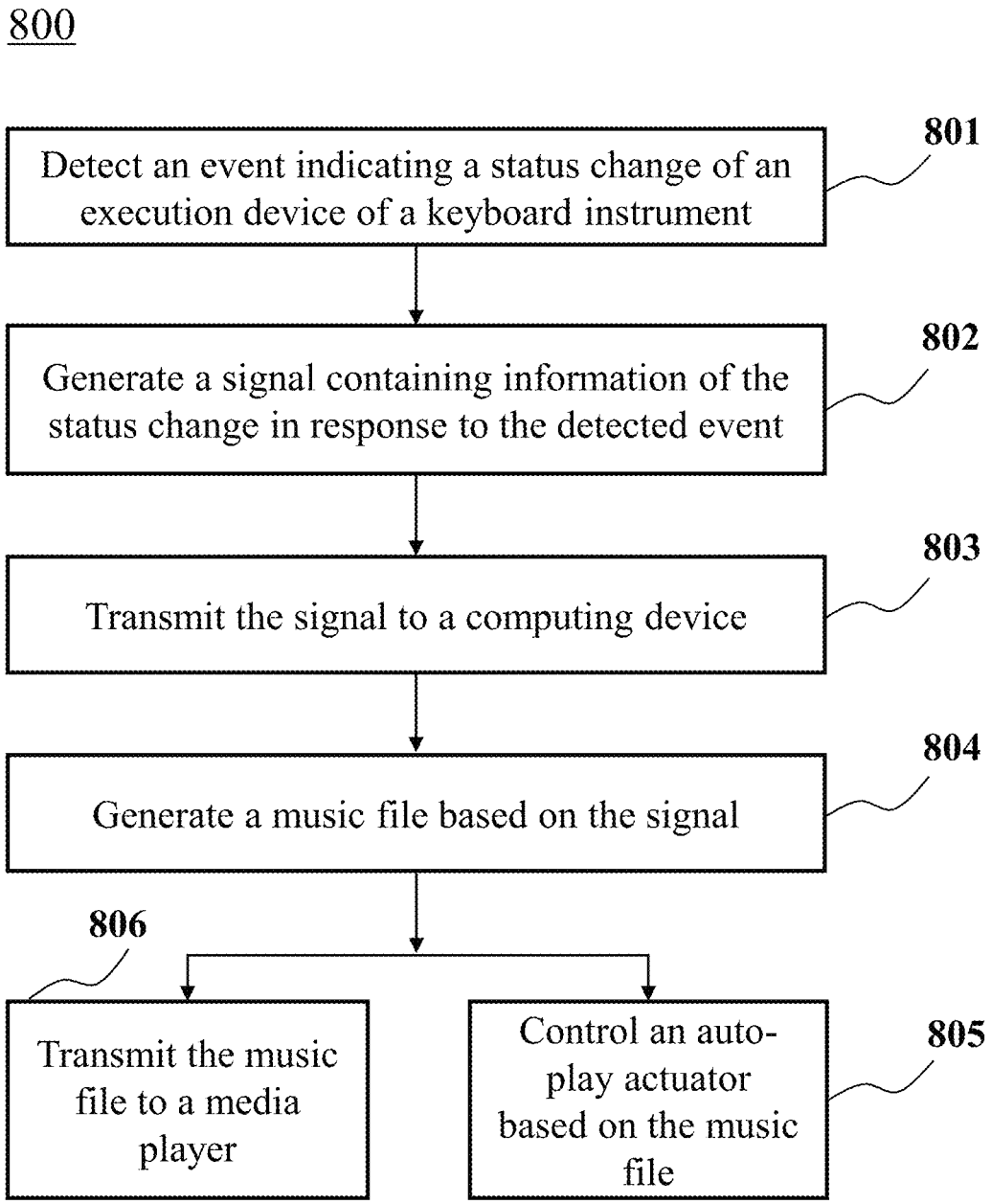
FIG. 8 is a flowchart illustrating an exemplary method of generating a music file for recording user performance of a keyboard instrument system according to some embodiments of the present disclosure.

FIG. 8 is a flowchart illustrating an exemplary method of generating a music file for recording user performance of a keyboard instrument system 100 according to some embodiments of the present disclosure. The method may be implemented by the keyboard instrument system 100. In some embodiments, the keyboard instrument system 100 may be played in a recording mode. The performance of the user may be recorded and stored in the form of an electronic file.

In 801, an event indicating a status change of an execution device 180 of a keyboard instrument system 100 may be detected. If a user plays the keyboard instrument system 100, one or more events may be caused by the execution devices in response to the user performance. The one or more events may indicate status changes of the execution devices. Exemplary types of the events may include but not be limited to one or more components of the execution devices' motion, sound, vibration, or the like, or a combination thereof. More description relating to the event indicating status change may be as described in connection with the execution module 210. The user performance information may be contained in the events. The one or more events may then be detected. The detection may be implemented by the signal detection module 220. The sensors 160 may detect the one or more events. The signal detection module 220 may analyze the detected one or more events and determine characteristics of the event(s) including, for example, user performance information.

In 802, a signal containing information of the status change in response to the detected event may be generated. The signal may be generated by the signal detection module 220. The signal may be a voltage signal, a current signal, or the like, or a combination thereof. The information of the status change may represent the user performance information.

In 803, the signal may be transmitted to a computing device of the keyboard instrument system 100 (e.g., the computing module 240). The computing device may be and/or include the computing module 240 included in the keyboard instrument system 100. The computing device may include the processor 120, memory 130, storage 140, I/O 190 as described in connection with FIG. 1. The computing device may be set inside or external to the keyboard instrument system 100. For example, a computer may be configured inside a piano. In some embodiments, a traditional keyboard instrument may be reconstructed to be the kind of keyboard instrument system 100 disclosed in the present disclosure. Under this circumstance, the computing device may be difficult to be integrated into the traditional keyboard instrument. A removable computer may be available for the reconstruction of traditional keyboard instrument. The reconstructed traditional keyboard instrument and the removable computer may be connected through wired or wireless connection.

Before being transmitted to the computing module 240, the signal may be preprocessed. Exemplary preprocessing may include amplifying, frequency-selecting, smoothing, peak holding, channel selecting, analog-to-digital converting, or the like, or a combination thereof. The preprocessing may further include converting the signal into a wireless signal. For example, if the computing device is a mobile phone, the signal may be processed and sent to the mobile phone wirelessly. After the processing, the processed signal may be transmitted to the computer.

In 804, a music file may be generated according to the signal. In some embodiments, the computing module 240 may process the signal and generate a music file based on the signal. Characteristics of the performance may be reflected in the music file. For example, when and which key is pressed may be record as a time and sequence number data in the music file. The strength of the pressing may be recorded as another set of parameter data in the music file. If the music file is read by some device, these parameter data (e.g., when and how to press the plurality of keys) may be determined according to the music file. In some embodiments, the music file generation may further include a modification step. The received signal may be modified to adjust timing information included therein. The modification step may be implemented by the modification unit 240. For example, the recording of the user performance may be with a time delay. The timing information included in the received signal may be adjusted to compensate the time delay. After the compensation, the received signal may further be used to generate the music file.

In 806, the music file may be transmitted to a media player. The media player may be the media play module 260 configured to play the music file. The media player may be connected with the keyboard instrument system 100 with wired or wireless method. The transmitting may be implemented by the computing module 240. The media player may execute a music play program installed therein to play the received music file.

In 805, an auto-play actuator may be controlled based on the music file. The controlling may be implemented by the computing module 240. The auto-play actuator 170 may be included in the auto-play module 250 to perform one or more auto-play functions. As described before, the music file may contain the user performance information that may be used for determining when and how to press which key of the execution devices. The auto-play actuator may be activated according to the user performance information. For example, when implementing the auto-play function, data may be read by the computing module 240. The data may include time information of starting at 1 minute, holding 1 second, second key, heavy pressing, or the like, or a combination thereof. The auto-play actuator 170 may drive the second key of the keyboard instrument system 100 to be pressed heavily at 1 minute relative to a starting time point and holding the pressing for 1 second. By repeating the step, music almost the same as the recorded performance of the user may be generated.

It should be noted that the signal processing method described above is for the purposes of illustration, and not intended to limit the scope of the present disclosure. Apparently, for persons having ordinary skills in the art, numerous variations and modifications may be conducted under the teaching of the present disclosure. However, those variations and modifications may not depart the protecting scope of the present disclosure. For example, steps 805 and 806 may be omitted in the process. The music file may be stored in the computing device for any other usage.

Figure 9:
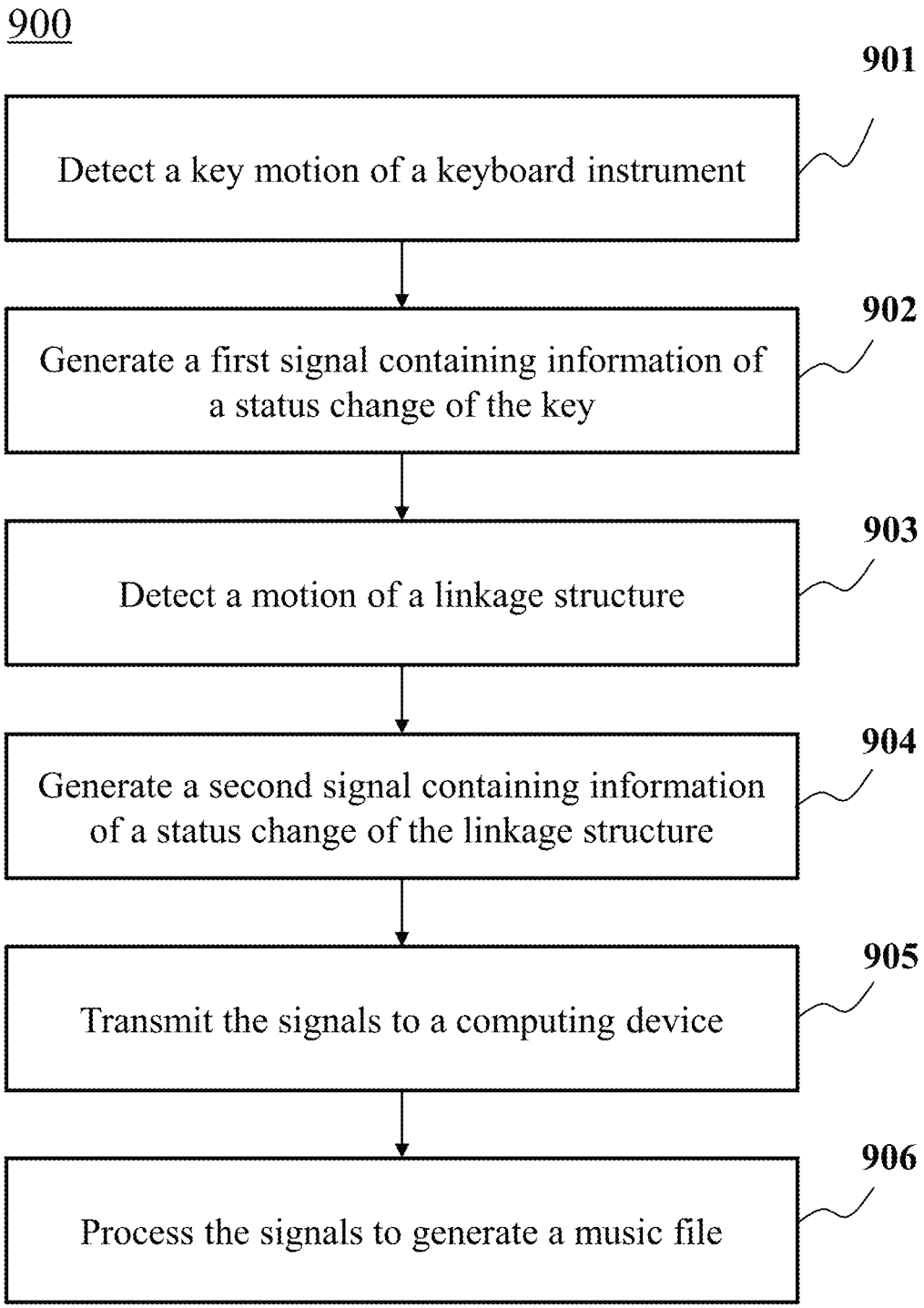
FIG. 9 is a flowchart illustrating an exemplary method of recording user performance of a keyboard instrument system according to some embodiments of the present disclosure.
Figure 10:
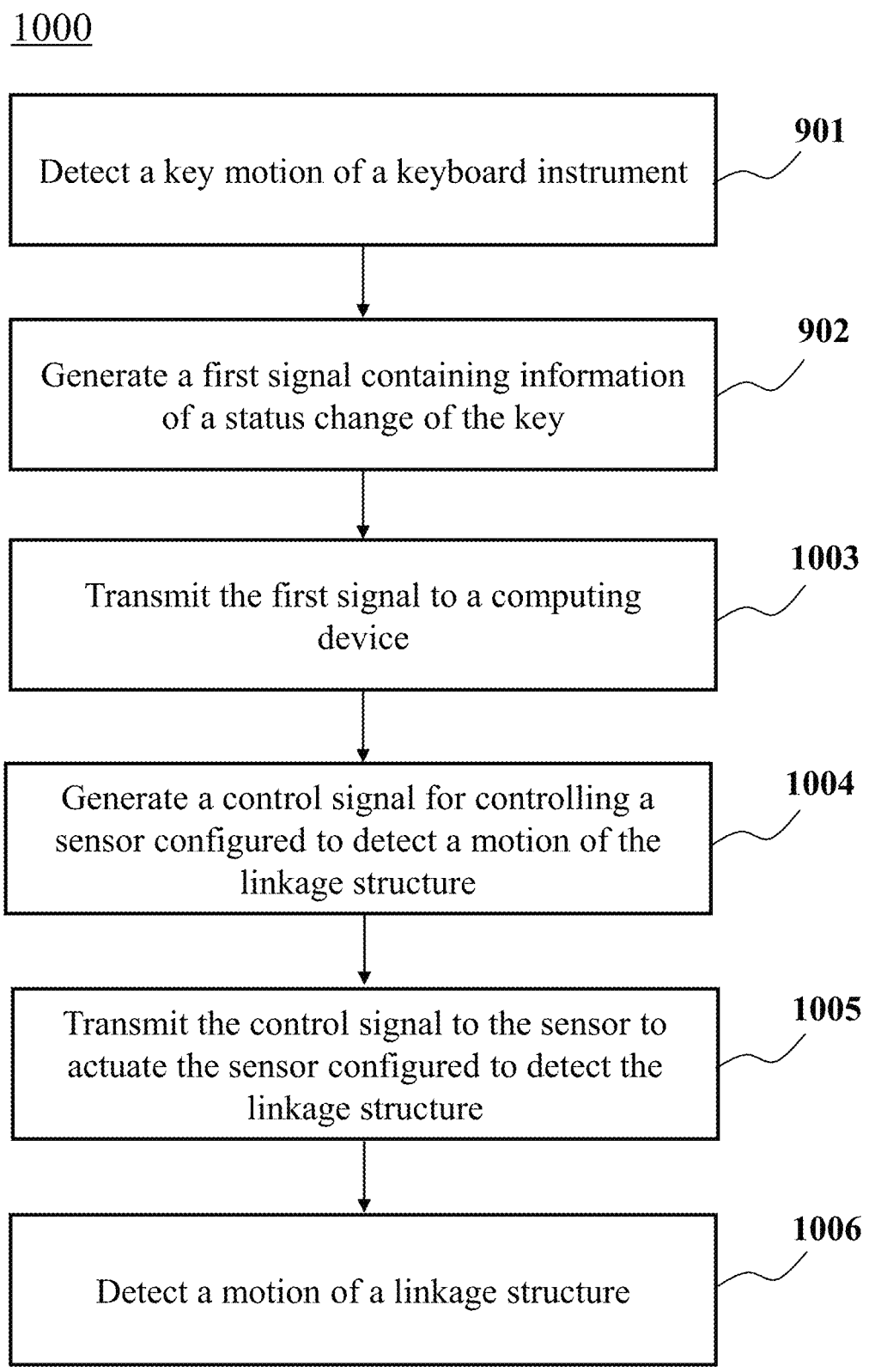
FIG. 10 is a flowchart illustrating an exemplary linkage structure detection method according to some embodiments of the present disclosure.

In some embodiments, steps 801 through 804 of the process 800 may be performed based on the exemplary process 900 for generating a music file illustrated in FIG. 9. In 901, a key motion of a keyboard instrument system 100 may be detected by signal detection module 220. If a user plays the keyboard instrument system 100, one or more events may be caused by the keys in response to the user performance. The one or more events may indicate status changes of the keys. The user performance information may be contained in the events. The one or more events may then be detected. The sensors 160 may detect the one or more events. The signal detection module 220 may analyze the detected one or more events and determine characteristics of the event(s) including, for example, user performance information.

In 902, a first signal containing information of a status change of the key may be generated by the signal detection module 220. As used herein, the first signal may refer to a type of signal generated according to the key motion. The first signal may be a voltage signal, a current signal, or the like, or a combination thereof. The information of the status change may represent the user performance information.

In 903, a motion of a linkage structure of the keyboard instrument system 100 may be detected by the signal detection module 220. In response to the key motion disclosed in 901, one or more events associated with the linkage structure may be caused. The one or more events may indicate status changes of the linkage structure. The user performance information may be contained in the events. The one or more events may then be detected. The sensors 160 may detect the one or more events. The signal detection module 220 may analyze the detected one or more events and determine characteristics of the event(s) including, for example, user performance information. In 904, a second signal containing information of a status change of the linkage structure may be generated by the signal detection module 220. The second signal may be a voltage signal, a current signal, or the like, or a combination thereof. The information of the status change may represent the user performance information. As used herein, the second signal may refer to a type of signal generated according to the motion of linkage structure.

In 905, the signals may be transmitted to the computing module 240 of the keyboard instrument system 100. The description of the transmission method may be similar to the description in FIG. 8.

In 906, a music file may be generated by the computing module 240 by processing the signals. Both of the first and second signals may be considered. In some embodiments, the two types of signals may contain different characteristics of the user performance information and used for the music file generation jointly. For example, in the key detection, an electro-optical sensor may correspond to each key of the keyboard instrument system 100. The sequence number of the keys pressed by the user may be recognized by the computing module 240. In the linkage structure detection, strength detection sensors may be positioned corresponding to each of the linkage structures. The striking strength may be detected by the signal detection module 220. However, interference vibration may be detected and may affect the determination of the sequence number of the key pressed by the user. In some embodiments, both of the analyzing results of the first and second signals may be considered. The sequence number and the striking strength may be obtained. In some embodiments, a correction step may be introduced in the processing. For example, if one of the sensors 160 configured to detect the key motion does not work, the music file generated according to the first signals may not be complete. The second signals may be used as double-check signals to confirm the first signals. If the assessment unit 243 determines that the first signals are not complete, the missing part may be compensated by the corresponding part in the second signals. For example, at a same time, the computing module 240 may receive a second signal but no first signal. The computing module 240 may compensate the first signal using the second signal.

It should be noted that the signal processing method described above for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure. For example, steps 901 and 902 may be performed simultaneously. As another example, steps 901 and 902 may be performed after step 903 or 904.

In some embodiments, step 903 of the process 900 may be performed based on the exemplary process 1000 for detecting a motion of a linkage structure illustrated in FIG. 9. As described above, in 901 and 902, a first signal containing information related to a status change of a key may be generated the signal detection module 220. In 1003, the first signal may be transmitted to the computing module 240 of the keyboard instrument system 100. The transmission method may be similar to 803.

In 1004, the control unit 241 may generate a control signal for controlling a sensor 160 configured to detect the linkage structure. The control signal generation may be implemented by the control unit 241 included in the computing module 240. In some embodiments, after receiving the first signal, the computing module 240 determine that a key is pressed. Because of the motion conduction, the pressed key may actuate a linkage structure to strike on the elastic structure corresponding to the pressed key. If the sensor 160 configured to detect the linkage structure is actuated by the control unit 241 before the strike occurring, the detection accuracy may be increased. The control signal may be used to control the sensor 160 to detect motion of the linkage structure.

In some embodiments, the number of the sensors may be so numerous that of the computing requirement for processing the signals generated by the sensors exceeds the computing capacity of the computing module 240. Communication channels of the computing module 240 for the plurality of sensors 160 positioned on the linkage structure may be limited. Not all of the sensors 160 may communicate with the computing module 240 simultaneously. If the computing module 240 receives the first signal, it may allocate a communication channel for the sensor 160 configured to detect the corresponding linkage structure(s).

In 1005, the computing module 240 may transmit the control signal to the sensor 160 configured to detect the linkage structure for actuation. In some embodiments, the sensor 160 configured to detect the linkage structure may work in the dormant state for lower power consumption. Upon receiving the control signal, the sensor 160 may be activated by the control signal to be ready for motion detection. In 1006, the sensor 160 configured to detect the linkage structure may detect a motion of a linkage structure.

Figure 11:
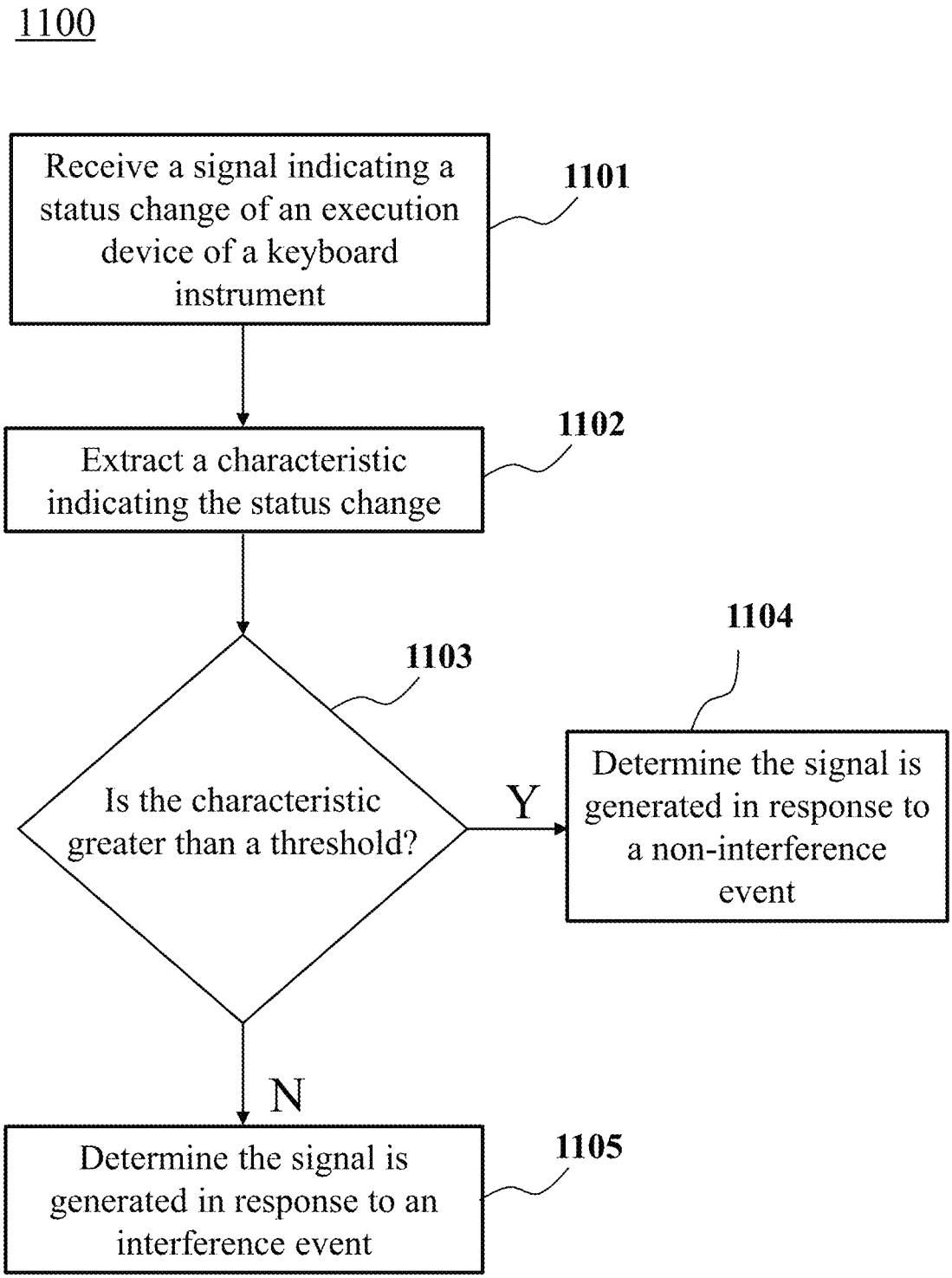
FIG. 11 is a flowchart illustrating an exemplary method of determining an interference event according to some embodiments of the present disclosure.

FIG. 11 is a flowchart illustrating an exemplary process of determining an interference event according to some embodiments of the present disclosure. The determination may be implemented by the computing module 240. In some embodiments, the signal received by the computing module 240 may be caused by an interference event. For example, the sensor 160 may detect vibrations of the other components except the linkage structure. This type of the vibration may be considered as being caused by interference events. The assessment unit 243 may assess and determine whether the detected vibration is caused by an interference event. For example, the characteristics of the signal caused by the interference event may be different from that of normal signals. Analyzing the characteristics of the signal may be effective to identify interference signal.

In 1101, the computing module 240 may receive a signal indicating a status change of the execution device 180 of the keyboard instrument system 100. The signal may be a signal transmitted from the signal detection module 220 or a processed signal transmitted from the signal processing module 230. The signal may contain user performance information. In some embodiments, the user performance information may be represented by some characteristics of the signal. Exemplary characteristics of the signal may include voltage intensity, current intensity, time of duration, full width at half maximum (FWHM), or the like, or a combination thereof. The characteristics may contain the striking information of the linkage structure included in the keyboard instrument system. For example, heavy striking may correspond to high intensity of voltage or current.

In 1102, the computing module 240 may extract a characteristic indicating the status change from the received signal. In some embodiments, one of the characteristics of the received signal may be used to determine by the assessment unit 243 whether the signal is generated in response to an interference event. For example, the computing module 240 may extract the FWHM of the received signal. A striking of the linkage structure may generate a pulse signal. The pulse signal may be shown as a peak in a diagram. The FWHM of the peak may be used to determine whether the pulse signal is generated in response to an interference event by comparing with a predetermined threshold. The signal with its FWHM lower than the predetermined threshold may be considered caused by an interference event.

In 1103, the assessment unit 243 may perform an assessment. The assessment unit 243 may determine whether the extracted characteristic in 1102 is equal to or greater than a threshold. If the assessment unit 243 determines that the characteristic is greater than the threshold, the process may proceed to step 1104; otherwise, the process may proceed to step 1105. In some embodiments, the threshold may be set as default according to experimental data. For example, vibration intensity conducted from other components of the keyboard instrument system 100 and a linkage structure may be measured for a number of times. A statistic distribution of the characteristics indicating the vibration intensity may be determined by the computing module 240. The threshold may be determined according to the statistic distribution. For example, a certain area in the statistic distribution may be considered as vibration intensity caused by linkage structure. The threshold may be determined based on the area in the statistic distribution.

In 1104, the assessment unit 243 may determine that the signal is generated in response to a non-interference event (e.g., a hammer striking event). The storage unit 242 may also store the signal for further use.

In 1105, the assessment unit 243 may determine that the signal is generated in response to an interference event (e.g., the vibration of other components conducted from elastic structure). The assessment unit 243 may omit or ignore the signal.

It should be borne in mind, however, that all of these and similar terms are to be associated with the appropriate physical quantities and are merely convenient labels applied to these quantities. Unless specifically stated otherwise, as apparent from the following discussion, it is appreciated that throughout the description, discussions utilizing terms such as "sending," "receiving," "generating," "providing," "calculating," "executing," "storing," "producing," "determining," "obtaining," "calibrating," "recording," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The terms "first," "second," "third," "fourth," used herein are meant as labels to distinguish among different elements and may not necessarily have an ordinal meaning according to their numerical designation.

In some implementations, any suitable computer readable media can be used for storing instructions for performing the processes described herein. For example, in some implementations, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read-only memory (EPROM), electrically erasable programmable read-only memory (EEPROM), etc.), any suitable media that is not fleeting or devoid of any semblance of permanence during transmission, and/or any suitable tangible media. As another example, transitory computer readable media can include signals on networks, in connectors, conductors, optical fibers, circuits, and any suitable media that is fleeting and devoid of any semblance of permanence during transmission, and/or any suitable intangible media.

It should be noted that the piano equipped with the heat dissipation system in some specific embodiments is provided for the purposes of illustration, and not intended to limit the scope of the present disclosure. Apparently for persons having ordinary skills in the art, numerous variations and modifications may be conducted under the teaching of the present disclosure. However, those variations and modifications may not depart the protecting scope of the present disclosure.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose, and that the present disclosure are not limited to the disclosed embodiments, but, on the contrary, are intended to cover modifications and equivalent arrangements that are within the spirit and scope of the disclosed embodiments. For example, although the implementation of various components described above may be embodied in a hardware device, it may also be implemented as a software only solution, e.g., an installation on an existing server or mobile device.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various inventive embodiments. This method of disclosure, however, is not to be interpreted as reflecting an intention that the claimed subject matter requires more features than are expressly recited in each claim. Rather, inventive embodiments lie in less than all features of a single foregoing disclosed embodiment.

What is claimed is:

1. A method for generating a music file for recording user performance in a strike simulation mode of a keyboard instrument, the method comprising:

detecting, by a sensor, an event indicating a status change of an execution device of the keyboard instrument, wherein the execution device includes a plurality of weight levers which are concrete structures in the keyboard instrument and weights of the weight levers decrease from a bass zone to a treble zone, and a plurality of elastic structures, wherein a strike on an elastic structure simulates a real rebound feel, wherein the event includes a first weight lever of the plurality of weight levers striking on a first elastic structure of the plurality of elastic structures to simulate a real rebound force generated by hammer striking on string and a rebound force for the first weight lever is transmitted to a key associated with the first weight lever and cause a user to feel the real rebound force;

generating, by the sensor, a signal corresponding to the detected event;

preprocessing, by a signal processing circuit, the signal by analog-to-digital converting and at least one of amplifying, frequency-selecting, smoothing, peak holding, or channel selecting;

receiving, by a processor, the signal after preprocessing; and generating, by the processor, a music file based on the signal.

2. The method of claim 1, further comprises transmitting, by the processor, the music file to a media player.

3. The method of claim 1, further comprises controlling, by the processor, an auto-play actuator based on the music the.

4. The method of claim 1, wherein the execution device further includes at least one of a key, a pedal, or a hammer.

5. The method of claim 1, wherein generating, by the processor, the music file based on the signal comprises:

obtaining timing information related to the user performance, the timing information including at least one of timing information related to pressing a key or using a pedal;

processing the signal according to the obtained timing information; and generating the music file based on the processed signal.

6. The method of claim 1, wherein the rebound force for the first weight lever is different from a rebound force for a second weight lever by adjusting parameters of the elastic structure or the weight lever.

7. The method of claim 1, wherein the sensor is configured to detect a strike by the weight lever to the elastic structure.

8. The method of claim 7, wherein the sensor is connected to the weight lever.

9. The method of claim 7, wherein the sensor is connected to the elastic structure.

10. The method of claim 7, wherein a buffer layer resides between the sensor and the elastic structure, and a vibration conduction layer resides between the sensor and the weight lever.

11. The method of claim 1, wherein, the generated signal includes a first signal and a second signal, the first signal being generated in response to a first event indicating a movement of a key, the second signal being generated in response to a second event indicating a movement of a linkage structure, and the music file is generated based on the first and second signals.

12. The method of claim 1, wherein the execution device of the keyboard instrument includes a linkage structure, the sensor includes a first sensor and a second sensor, and the detecting, by the sensor, the event indicating the status change of the execution device of the keyboard instrument includes:

detecting, by the first sensor, a key motion of the keyboard instrument;

generating, by the first sensor, a first signal;

receiving, by the processor, the first signal to generate a control signal for controlling the second sensor for detecting a motion of the linkage structure; and receiving, by the second sensor, the control signal to detect the motion of linkage structure.

13. The method of claim 1, further comprising;

determining a parameter value of the signal indicating a status change of the execution device of the keyboard instrument;

determining whether the parameter value is less than a threshold; and determining, if the parameter value is less than a threshold, the signal is generated in response to an interference event.

14. A system for generating a music file for recording user performance in a strike simulation mode of a keyboard instrument, comprising:

at least one processor; and storage for storing instructions, the instructions, when executed by the at least one processor, causing the system to perform a method including:

detecting, by a sensor, an event indicating a status change of an execution device of the keyboard instrument, wherein the execution device includes a weight lever, which is a concrete structure in the keyboard instrument, and the event includes the weight lever striking on an elastic structure to simulate a rebound force generated by hammer striking on string;

wherein the execution device includes a plurality of weight levers which are concrete structures in the keyboard instrument and weights of the weight levers decrease from a bass zone to a treble zone, and a plurality of elastic structures, wherein a strike on an elastic structure simulates a real rebound feel, wherein the event includes the a first weight lever of the plurality of weight levers striking on a first elastic structure of the plurality of elastic structures to simulate a real rebound force generated by hammer striking on string and a rebound force is transmitted to a key associated with the first weight lever and cause a user to feel the real rebound force;

generating, by the sensor, a signal corresponding to the detected event;

preprocessing, by a signal processing circuit, the signal by analog-to-digital converting and at least one of amplifying, frequency-selecting, smoothing, peak holding, or channel selecting;

receiving, by the at least one processor, the signal after preprocessing; and generating, by the at least one processor, a music file based on the signal.

15. The system of claim 14, wherein the generated signal includes a first signal and a second signal, the first signal being generated in response to a first event indicating a movement of a key, the second signal being generated in response to a second event indicating a movement of a linkage structure, and the music file is generated based on the first and second signals.

16. The system of claim 14, wherein, the execution device of the keyboard instrument includes a linkage structure, the sensor includes a first sensor and a second sensor, and the detecting, by the sensor, the event indicating the status change of the execution device of the keyboard instrument includes:

detecting, by the first sensor, a key motion of the keyboard instrument;

generating, by the first sensor, a first signal;

receiving, by the processor, the first signal to generate a control signal for controlling the second sensor for detecting a motion of the linkage structure; and receiving, by the second sensor, the control signal to detect the motion of linkage structure.

17. The system of claim 14, wherein the method further comprising:

determining a parameter value of the signal indicating a status change of the execution device of the keyboard instrument:

determining whether the parameter value is less than a threshold; and determining, if the parameter value is less than a threshold, the signal is generated in response to an interference event.

* * * * *